US008643689B2

(12) United States Patent
Ishimi et al.

(10) Patent No.: US 8,643,689 B2
(45) Date of Patent: Feb. 4, 2014

(54) IMAGE PROCESSING METHOD AND IMAGE PROCESSING APPARATUS

(75) Inventors: Tomomi Ishimi, Shizuoka (JP); Yoshihiko Hotta, Shizuoka (JP); Shinya Kawahara, Shizuoka (JP); Toshiaki Asai, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/404,197

(22) Filed: Feb. 24, 2012

(65) Prior Publication Data

US 2012/0218540 A1 Aug. 30, 2012

(30) Foreign Application Priority Data

Feb. 28, 2011 (JP) ..... 2011-042331

(51) Int. Cl.
*B41J 2/435* (2006.01)

(52) U.S. Cl.
USPC ..... 347/236; 347/246

(58) Field of Classification Search
USPC ..... 347/224, 225, 236, 237, 246, 247
See application file for complete search history.

(56) References Cited

U.S. PATENT DOCUMENTS

| | | | | |
|---|---|---|---|---|
| 6,836,282 | B2 * | 12/2004 | Vosseler et al. | 347/247 |
| 6,989,854 | B1 | 1/2006 | Figov et al. | |
| 7,439,993 | B2 | 10/2008 | Ishimi et al. | |
| 8,098,266 | B2 | 1/2012 | Asai et al. | |
| 8,101,334 | B2 | 1/2012 | Ishimi et al. | |
| 8,106,934 | B2 | 1/2012 | Ishimi et al. | |
| 8,164,610 | B2 * | 4/2012 | Nakata et al. | 347/224 |
| 2002/0044196 | A1 | 4/2002 | Vosseler et al. | |
| 2007/0225162 | A1 | 9/2007 | Kawahara et al. | |
| 2008/0064596 | A1 | 3/2008 | Iino et al. | |
| 2008/0153698 | A1 | 6/2008 | Kawahara et al. | |
| 2008/0192618 | A1 | 8/2008 | Nakata et al. | |
| 2009/0075816 | A1 | 3/2009 | Kawahara et al. | |
| 2009/0203521 | A1 | 8/2009 | Ishimi et al. | |
| 2010/0061198 | A1 * | 3/2010 | Kawahara et al. | 369/13.01 |
| 2010/0069238 | A1 | 3/2010 | Asai et al. | |
| 2010/0069239 | A1 | 3/2010 | Asai et al. | |
| 2010/0197492 | A1 * | 8/2010 | Kawahara et al. | 503/201 |
| 2011/0090296 | A1 | 4/2011 | Ishimi et al. | |
| 2011/0090299 | A1 | 4/2011 | Asai et al. | |
| 2011/0207603 | A1 | 8/2011 | Kawahara et al. | |
| 2012/0075402 | A1 | 3/2012 | Ishimi et al. | |

FOREIGN PATENT DOCUMENTS

| | | |
|---|---|---|
| EP | 1176545 A2 | 1/2002 |
| JP | 9-30118 | 2/1997 |
| JP | 11-151856 | 6/1999 |
| JP | 2000-136022 | 5/2000 |

(Continued)

OTHER PUBLICATIONS

European search report dated Jul. 3, 2012 in connection with corresponding European patent application No. 12 157 350.5.

*Primary Examiner* — Hai C Pham
(74) *Attorney, Agent, or Firm* — Cooper & Dunham LLP

(57) ABSTRACT

An image processing method including: measuring a distance between a medium where an image is to be recorded and an image processing apparatus which stores a relation between irradiation energy and distance previously measured; calculating an irradiation energy from the distance measured in the measuring based on the relation stored in the image processing apparatus; and irradiating and heating the medium with laser beams having the irradiation energy obtained in the calculating to record an image in the medium.

14 Claims, 8 Drawing Sheets

(56) References Cited

FOREIGN PATENT DOCUMENTS

| | | |
|---|---|---|
| JP | 3161199 | 2/2001 |
| JP | 2003-136260 | 5/2003 |
| JP | 2004-265247 | 9/2004 |
| JP | 2006-315035 | 11/2006 |
| JP | 3998193 | 8/2007 |
| JP | 2008-62506 | 3/2008 |
| JP | 2008-68312 | 3/2008 |
| JP | 2008-194905 | 8/2008 |
| JP | 2008-213439 | 9/2008 |
| WO | WO97/27065 | 7/1997 |

* cited by examiner

IMAGE PROCESSING METHOD AND IMAGE PROCESSING APPARATUS

BACKGROUND OF THE INVENTION

1. Field of the Invention

The present invention relates to an image processing method and an image processing apparatus capable of performing high-quality image recording with less faint printing and bleeding, having improved durability to repeated printing, being low cost, and exhibiting high processing speed.

2. Description of the Related Art

To date, image recording and image erasing on a thermoreversible recording medium (hereinafter may be referred to as "recording medium") have been performed in a contact manner where a heat source is brought into contact with a recording medium to heat the recording medium. The heat source used is generally a thermal head for image recording and a heat roller or a ceramic heater for image erasing.

In such contact-type recording method, when the thermoreversible recording medium is flexible one such as a film or paper, a platen is used to uniformly press the heat source against the thermoreversible recording medium, whereby uniform image recording and image erasing can be performed. In addition, conventionally used parts of printers for thermosensitive paper can be used also for this method to produce an image recording apparatus and an image erasing apparatus, which is advantageous.

However, when the thermoreversible recording medium has an RF-ID tag therein as described in, for example, Japanese Patent Application Laid-Open (JP-A) No. 2004-265247 and Japanese Patent (JP-B) No. 3998193, the thickness of the thermoreversible recording medium is large and the flexibility of the thermoreversible recording medium decreases. As a result, uniformly pressing the heat source requires a high pressure. Also, contacting the heat source with the recording medium scrapes off the surface of the recording medium to form concaves and convexes, when printing and erasing are performed repeatedly. Then, there are formed areas which cannot come into contact with the heat source such as a thermal head or a hot stamp, resulting in failure to uniformly heat the surface of the recording medium to cause problems such as decrease in density and erase failure (see JP-B No. 3161199 and JP-A No. 09-30118).

Since the information stored in the RF-ID tag is read and rewritten in a non-contact manner (at a distance), there has been increased desire to rewrite the image of the thermoreversible recording medium in a non-contact manner. For example, there has been proposed a method using a laser as a method for uniformly recording and erasing images in a non-contact manner or at a distance, which method is employed when the surface of the thermoreversible recording medium has convexes and concaves (see JP-A No. 2000-136022). This proposed method performs non-contact recording on thermoreversible recording media used in conveyance containers for logistics lines. And, this patent literature describes that writing is performed with a laser and erasing is performed with hot air, hot water or an infrared heater.

Such a laser recording method is performed with a laser recording apparatus (laser marker) capable of applying high-power laser beams to thermoreversible recording media and controlling the position where the laser beams are applied. This laser marker can be used to apply laser beams to a thermoreversible recording medium so that the light heat converting material in the recording medium converts light into heat which can be used to record and erase images. Hitherto, as a method for recording and erasing images using laser beams, there has been proposed a method for recording images with near-infrared laser beams using in combination a leuco dye, a reversible color developer, and various light heat converting materials (see JP-A No. 11-151856).

Using the prior arts described in JP-A Nos. 2008-62506 and 2008-213439, it is possible to uniformly heat a recording medium to improve the recording medium in image quality and durability to repeated printing. However, the time required for image recording and erasing is elongated due to jump between the drawing lines and the waiting time.

Furthermore, JP-A No. 2008-194905 discloses a method in which the surface conditions of the recording medium are detected and then the irradiation energy is controlled according to the detection. This method can print high-quality images even on fine convexes and concaves by controlling the irradiation energy. However, it requires high-precise control and poses a problem in that the cost required for the apparatus becomes too high to be employed practically.

JP-A No. 2008-68312 discloses a method in which the position of a recording medium is detected and then the position of a lens is controlled according to the detection result so that the diameter of the irradiation spot becomes constant. However, the lens system for controlling the irradiation spot diameter is complicated to problematically elevate the cost required for the apparatus.

So far, there has not yet been provided an image processing method and an image processing apparatus which measure the distance between the image processing apparatus and the medium and control the irradiation energy of laser beams based on the measured distance, thereby performing high-quality image recording with less faint printing and bleeding, exhibiting improved durability to repeated printing, being low cost, and exhibiting high processing speed.

SUMMARY OF THE INVENTION

The present invention aims to provide an image processing method and an image processing apparatus which measure the distance between an image processing apparatus and a medium where an image is to be recorded and control the irradiation energy of laser beams based on the measured distance, thereby performing high-quality image recording with less faint printing and bleeding, exhibiting improved durability to repeated printing, being low cost, and exhibiting high processing speed.

The present inventors conducted extensive studies to solve the above existing problems and have found that a series of measuring the distance between the medium where an image is to be recorded and an image processing apparatus and controlling the irradiation energy of laser beams based on the measured distance can realize a constant energy density, thereby providing an image processing method and an image processing apparatus which involve no degradation in quality of printed images and have improved durability to repeated printing.

The present invention is based on the finding obtained by the present inventors, and means for solving the above problems are as follows.

An image processing method of the present invention includes: a distance measuring step of measuring a distance between a medium where an image is to be recorded and an image processing apparatus which stores a relation between irradiation energy and distance previously measured; an irradiation energy calculating step of calculating an irradiation energy from the distance measured in the measuring based on the relation stored in the image processing apparatus; and an image recording step of irradiating and heating the medium with laser beams having the irradiation energy obtained in the calculating to record an image in the medium.

Conventionally, image recording (printing) in the medium has generally been performed at a position distant from an image processing apparatus where the beam diameter becomes minimum (focal position) and the line width can be made thinnest. In that case, when the distance between the medium and the image processing apparatus is changed, the beam diameter becomes large depending on the distance from the focal position so that the energy density decreases. As a result, sufficient energy for printing is not applied to the medium to degrade quality of printed images to cause, for example, faint letters (thin line width, and a drop in printing density).

Meanwhile, to form bold line width, the beam diameter has conventionally been enlarged by setting the medium at a position distant from the focal position. Similar to the above, when the distance between the medium and the image processing apparatus is changed, the beam diameter is also changed depending on the distance from the focal position so that the energy density is changed accordingly. As a result, sufficient energy for printing is not applied to the medium to degrade quality of printed images to cause, for example, faint letters (thin line width, and a drop in printing density). In contrast, when the energy density becomes high, excessive energy is applied to the medium to degrade quality of printed images to cause, for example, bleeding. Also in this case, a repeatedly usable medium suffers damage to be decreased in durability to repeated printing.

As described above, the change in energy density depending on the distance between the medium and the image processing apparatus is due to the change in the beam diameter, since the laser irradiation energy is constant.

In the present invention, controlling the laser irradiation energy in response to the beam diameter changing depending on the distance between the medium and the image processing apparatus makes an energy density constant to thereby realize printing with neither degradation of quality of printed images nor degradation of durability to repeated printing.

In some of the conventional methods, convexes and concaves of the medium are photographed with, for example, a CCD camera, and then the laser irradiation energy is controlled depending on the height differences between the convexes and concaves. These methods can provide good printing quality but controlling the laser irradiation energy in the image processing apparatus becomes complicated. As a result, the image processing apparatus becomes expensive and the printing speed has to be decreased to follow the control. In addition, a sensor for measuring the height differences between the convexes and concaves in the medium is expensive, and the processing speed becomes slow.

In the present invention, the distance between the image processing apparatus and the medium is measured at one to several positions and the laser irradiation energy is controlled based on the distance(s) measured at the one to several positions. By doing so, it becomes easy to control the laser irradiation energy, complicated control is not necessary, and high-speed processing can be achieved.

The present invention can provide an image processing method and an image processing apparatus which measure the distance between the image processing apparatus and the medium where an image is to be recorded and control the irradiation energy of laser beams based on the measured distance, thereby performing high-quality image recording with less faint printing and bleeding, exhibiting improved durability to repeated printing, being low cost, and exhibiting high processing speed. These can solve the above existing problems and achieve the above objects.

Figure 1A:
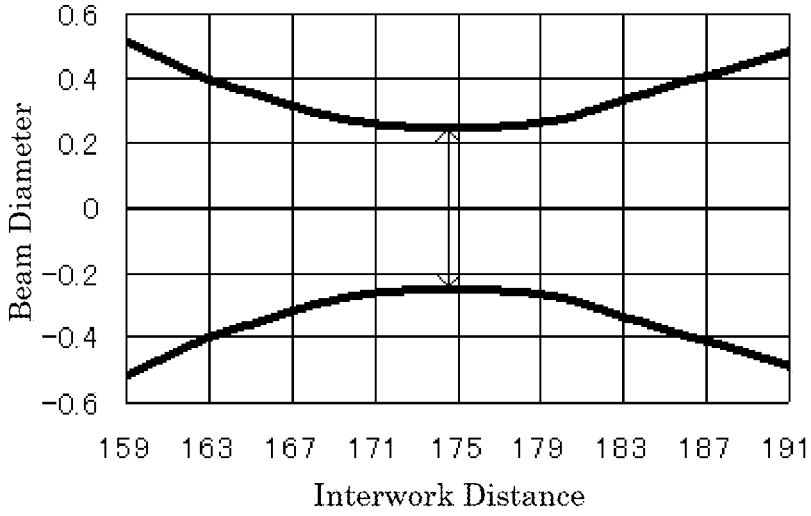
FIG. 1A is a graph indicating a relation between interwork distance and beam diameter of a common laser marker device, where the double-sided arrow corresponds to the beam diameter.

DETAILED DESCRIPTION OF THE INVENTION (Image Processing Method)

An image processing method of the present invention includes at least a distance measuring step, an irradiation energy calculating step, and an image recording step; preferably includes an image erasing step; and, if necessary, further includes other steps.

<Distance Measuring Step>

The distance measuring step is a step of measuring a distance between a medium where an image is to be recorded and an image processing apparatus which stores a relation between irradiation energy and distance previously measured.

Here, the distance between the image processing apparatus and the medium where an image is to be formed is called "interwork distance" and refers to a distance between the medium and a laser beam emitting surface of the optical head of the image processing apparatus. The "interwork distance" can be measured using, for example, a scale or sensor. When the "interwork distance" is measured with a sensor and then corrected based on the measurement results, for example, the "interwork distance" can be measured with a laser displacement meter (product of Panasonic Electric Works Co., Ltd.) and then the measurement results can be corrected with the image processing apparatus.

When the medium is not oblique so much, the interwork distance is preferably measured at one position of the medium, since the measurement can be simplified to realize cost reduction. When recording is performed on an oblique medium, it is necessary to measure the interwork distances at several positions, preferably at three positions. It is possible to correct the irradiation energy on each of the irradiation positions in the medium surface depending on the oblique angle of the medium.

The medium is not particularly limited and may be various recording media. As described below, particularly preferred is a thermoreversible recording medium in which image recording and erasing can be performed repeatedly.

The distance can be measured in any manner appropriately selected depending on the intended purpose. For example, it can be measured with a distance sensor.

Examples of the distance sensor include a non-contact-type distance sensor and a contact-type distance sensor. The contact-type distance sensor can do damage to the medium to be measured and makes it difficult to rapidly measure the distance. Thus, the contact-type distance sensor is preferred. Among the contact-type distance sensors, a laser displacement sensor is particularly preferred since it can rapidly and accurately measure the distance and is inexpensive and small.

Considering that the medium is oblique, the position at which the above distance is measured with the distance sensor is preferably a central portion of the medium where image is to be recorded, since the obtained distance corresponds to an average distance between the medium and the image processing apparatus.

When the distance is measured at several positions, the irradiation energy is corrected with respect to each irradiated positions through calculation based on the measured distances at the measured positions assuming that the medium is three-dimensionally oblique.

<Irradiation Energy Calculating Step>

The irradiation energy calculating step is a step of calculating irradiation energy from the distance measured in the distance measuring step based on the relation stored in the image processing apparatus.

The optical system of the image processing apparatus determines a shape of beams in the distance between the image processing apparatus and the medium, and determines the relation between the optimal irradiation energy and the distance between the image processing apparatus and the medium. The image processing apparatus is made to store in advance the relation between the optimal irradiation energy and the distance between the image processing apparatus and the medium In general, an error is generated depending on the position at which the distance meter is set. Thus, the image processing apparatus is made to store in advance the distances measured using the distance meter with the medium placed at a reference position. Then, preferably, on the basis of the difference between the reference distance and the actual distance obtained by measuring the medium where an image is to be recorded using the distance meter, the irradiation energy is calculated to correct the position of the distance meter.

For example, in the case where a reference surface of the image processing apparatus is 175 mm distant from the medium which is the minimum distance between the medium and the laser beam emitting surface of the optical head of the image processing apparatus disposed in parallel, when a medium is set at the reference surface and the distance is measured with the distance meter to give 170 mm, the image processing apparatus is made to store 175 mm (i.e., the distance between the medium and the optical head of the image processing apparatus disposed in parallel) and 170 mm (i.e., the distance between the optical head of the image processing apparatus and the medium set at the reference surface). Then, when a medium where an image is to be recorded is set at a position and the distance is measured with the distance meter to give 180 mm, this distance is corrected to 185 mm by the image processing apparatus. This corrected distance is used to calculate an irradiation energy dose to be corrected, based on the relation between optimal irradiation energy and distance from the image processing apparatus to the medium.

Figure 1B:
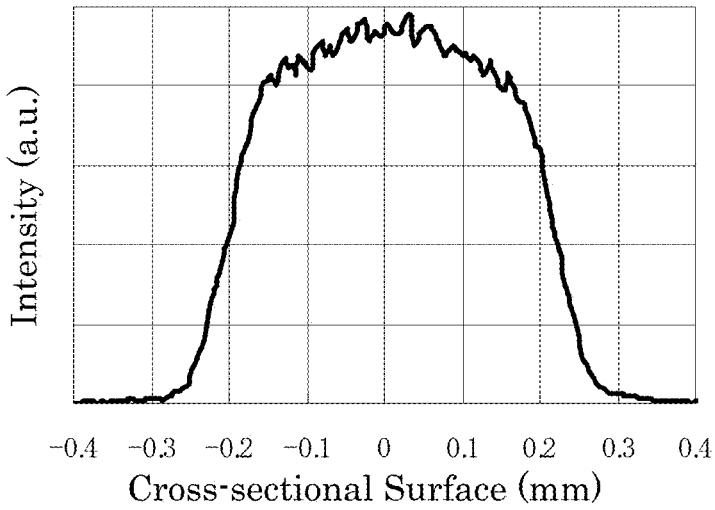
FIG. 1B is a graph explaining light distribution at a focal position of a common laser marker device.

The image processing apparatus condenses beams on the medium to record small letters and images. As shown in FIGS. 1A and 1B, the beam diameter and the light distribution change depending on the distance between the image processing apparatus and the medium, and thus the irradiation energy suitable for optimal beam diameter and light distribution also changes. Then, the image processing apparatus used in the present invention is made to store irradiation energies suitable for the distance between the image processing apparatus and the medium, and the irradiation energy dose to be corrected is calculated based on the distance measured and the corrected irradiation energy is used for recording of the medium.

The image processing method of the present invention is preferably performed with four image processing apparatuses according to the following embodiments.

(1) An image processing apparatus containing: at least a laser beam emitting unit configured to emit laser beams; a laser beam scanning unit configured to scan the laser beams on a surface of the medium where the surface is to be irradiated with the laser beams; and an fθ lens, where the fθ lens corrects an irradiation distance in the surface of the medium irradiated with the laser beams.

Here, the irradiation distance in the surface of the medium refers to an optical path length of laser beams applied from a laser beam source to the medium via an optical lens and a scanning mirror. The angle of the scanning mirror changes depending on a position in the medium at which the laser beams are applied. As a result, the optical path length also changes depending on the position in the medium at which the laser beams are applied.

When the medium is scanned with laser beams, the irradiation distance of laser beams is longer at the peripheral portion than at the central portion. However, according to the embodiment (1), the fθ lens is used to optically adjust the focal length at the central portion and the peripheral portion of the medium to obtain substantially the same beam diameter and light distribution shape at the central portion and the peripheral portion of the medium. In this manner, the beam diameter can be controlled only by an optical system.

(2) An image processing apparatus containing: at least a laser beam emitting unit configured to emit laser beams; a laser beam scanning unit configured to scan the laser beams on a surface of the medium where the surface is to be irradiated with the laser beams; and a lens system disposed between the laser beam emitting unit and the laser beam scanning unit and containing a lens the position of which can be moved, where the lens system corrects the irradiation distance in the medium surface irradiated with the laser beams.

Here, the irradiation distance in the surface of the medium has the same meaning as described in the embodiment (1).

When the medium is scanned with laser beams, the irradiation distance of laser beams is longer at the peripheral portion than at the central portion. However, according to the embodiment (2), the position of the lens is adjusted to adjust the focal length at the central portion and the peripheral portion of the medium to obtain substantially the same beam diameter and light distribution shape at the central portion and the peripheral portion of the medium. This embodiment realizes a simple optical design without using an fθ lens, and condenses beams before reaching a scanning mirror to elongate the focal length and deepen the focal depth, whereby an inexpensive apparatus with a smaller scanning mirror can be obtained.

(3) An image processing apparatus containing: at least a laser beam emitting unit configured to emit laser beams; a laser beam scanning unit configured to scan the laser beams on a surface of the medium where the surface is to be irradiated with the laser beams; and a lens system disposed between the laser beam emitting unit and the laser beam scanning unit and containing a lens the position of which can be moved, where the lens system corrects at least one of the position of the medium and the irradiation distance in the surface of the medium irradiated with the laser beams.

Here, the irradiation distance in the surface of the medium has the same meaning as described in the embodiment (1), and the position of the medium refers to the distance between the medium and the laser beam emitting surface of the optical head of the image processing apparatus; i.e., interwork distance.

When the medium is scanned with laser beams, the irradiation distance of laser beams is longer at the peripheral portion than at the central portion. Also, the interwork distance changes depending on the position of the medium. However, according to the embodiment (3), the position of the lens is adjusted to adjust the focal length at the central portion and the peripheral portion of the medium at each interwork distance to obtain substantially the same beam diameter and light distribution shape at the central portion and the peripheral portion of the medium regardless of the position of the medium. This embodiment realizes a simple optical design without using an fθ lens, and condenses beams before reaching a scanning mirror to elongate the focal length and deepen the focal depth, whereby an inexpensive apparatus with a smaller scanning mirror can advantageously be obtained. Here, the adjustable range is limited to a range where the adjustment can be performed at each interwork distance. Thus, combining with adjusting the irradiation energy can broaden the adjustable range of the interwork distance.

(4) An image processing apparatus containing: at least a laser beam emitting unit configured to emit laser beams; and a laser beam scanning unit configured to scan the laser beams on a surface of the medium where the surface is to be irradiated with the laser beams, where the irradiation energy is adjusted to correct at least one of the position of the medium and the irradiation distance in the surface of the medium irradiated with the laser beams.

Here, the irradiation distance in the surface of the medium has the same meaning as described in the embodiment (1), and the position of the medium has the same meaning as described in the embodiment (3).

When the medium is scanned with laser beams, the irradiation distance of laser beams is longer at the peripheral portion than at the central portion; i.e., the beam diameter is not the same at the central portion and the peripheral portion of the medium. However, according to the embodiment (4), the irradiation energy can be adjusted for correction and thus an optical system and a control system are both inexpensive. Here, the beam diameter becomes large at the peripheral portion of the medium, so that a correctable region (printable range, interwork distance) becomes narrowed.

<Image Recording Step>

The image recording step is a step of irradiating and heating the medium with the laser beams having the irradiation energy modulated based on the distance measured, to thereby record an image in the medium.

The irradiation energy of the laser beams is proportional to P/V where P denotes an irradiation power of laser beams on the medium, and V denotes a scanning velocity of laser beams on the medium.

Thus, preferably, by adjusting at least one of the scanning velocity (V) and the irradiation power (P) of laser beams, the irradiation energy of laser beams is adjusted so that the P/V becomes substantially constant.

In controlling the laser irradiation energy, the laser irradiation energy can be increased by decreasing the scanning velocity of laser beams or by increasing the irradiation power of laser beams. Also, the laser irradiation energy can be decreased by increasing the scanning velocity of laser beams or by decreasing the irradiation power of laser beams.

The method for controlling the scanning velocity of laser beams is not particularly limited and may be appropriately selected depending on the intended purpose. Examples thereof include a method of controlling the rotation speed of a motor responsible for the operation of a scanning mirror.

The method for controlling the irradiation power is not particularly limited and may be appropriately selected depending on the intended purpose. Examples thereof include a method of changing the set value of the light irradiation power and, in the case of irradiation of the pulse laser, a method of adjusting the pulse time width.

Examples of the method of changing the set value of the light irradiation power include a method of changing the set power value in the recording portion. Examples of the method of controlling the pulse time width include a method of changing the time width of pulsing in the recording portion. With these methods, it is possible to control the irradiation energy by controlling the irradiation power.

The output power of the laser beams irradiated in the image recording step is not particularly limited and may be appropriately selected depending on the intended purpose. It is preferably 1 W or more, more preferably 3 W or more, still more preferably 5 W or more. When the output power of laser beams is less than 1 W, it takes a long time to perform image recording. In an attempt to shorten the time required for image recording, the output power becomes insufficient. The upper limit of the output power of laser beams is not particularly limited and may be appropriately selected depending on the intended purpose. It is preferably 200 W, more preferably 150 W, still more preferably 100 W. When the output power of laser beams exceeds 200 W, a large laser device has to be used in some cases.

The scanning velocity of laser beams irradiated in the image recording step is not particularly limited and may be appropriately selected depending on the intended purpose. It is preferably 300 mm/s or more, more preferably 500 mm/s or more, still more preferably 700 mm/s or more. When the scanning velocity is less than 300 mm/s, it takes a long time to perform image recording. The upper limit of the scanning velocity of laser beams is not particularly limited and may be appropriately selected depending on the intended purpose. It is preferably 15,000 mm/s, more preferably 10,000 mm/s, still more preferably 8,000 mm/s. When the scanning velocity exceeds 15,000 mm/s, the scanning velocity becomes difficult to control to make it difficult to form uniform images.

The spot diameter of laser beams irradiated in the image recording step is not particularly limited and may be appropriately selected depending on the intended purpose. It is preferably 0.02 mm or more, more preferably 0.1 mm or more, still more preferably 0.15 mm or more. The upper limit of the spot diameter of laser beams is not particularly limited and may be appropriately selected depending on the intended purpose. It is preferably 3.0 mm, more preferably 2.5 mm, still more preferably 2.0 mm. When the spot diameter is small, the line width of the formed image becomes thin, leading to a drop in visibility. Whereas when the spot diameter is large, the line width of the formed image becomes bold, making it impossible to record a small-size image.

Examples of the laser beam source include a YAG laser, a fiber laser, a laser diode and a fiber coupling laser. In order to record a visible image with laser, it is necessary to uniformly heat a recording region of a medium irradiated with laser beams. Commonly used laser beams have a Gaussian distribution and thus become high in intensity at the central portion of the medium. Recording the medium by such laser beams lowers the contrast at the peripheral portion than that at the central portion, resulting in poor visibility and image quality. One possible measure against this problem is inserting in the optical path a light distribution-modifying optical element (e.g., an aspheric lens or a DOE element). This measure elevates the cost required for apparatus, and also makes difficult optical design for preventing skewness of light distribution due to aberration. However, when using a fiber coupling laser, laser beams of a top hat form can be easily obtained from the end of the fiber without using any light distribution-modifying optical element, enabling recording of an image having a high visibility. Thus, a fiber coupling laser is particularly preferably used.

In the other lasers having a Gaussian distribution, the beam diameter becomes larger while keeping a Gaussian distribution as the laser is distanced from the focal length (point). Thus, as the laser is distanced from the focal length (point), the line width becomes broad to cause a drop in visibility. The fiber coupling laser has a top hat-form light distribution at the focal position. Although the beam diameter of the fiber coupling laser becomes larger as the fiber coupling laser is distanced from the focal length (point), the beam diameter at the central portion irradiated with higher energy beams does not become large. Even when the fiber coupling laser is distanced from the focal length, the line width of the formed image does not become broad. Thus, a fiber coupling laser is particularly preferably used.

In general, laser beams have a Gaussian distribution at both the focal position and a position distant therefrom, and only the beam diameter becomes large. Thus, when the energy density is set constant, the line width of the printed image becomes broad in proportion to the beam diameter.

The fiber coupling laser combines laser beams with a fiber, where the laser beams are made to be uniform. It can provide a top hat-form light distribution at the focal position. Although the beam diameter becomes large as distanced from the focal position, it is close to light distribution having a Gaussian distribution. Since printed lines are formed when the energy exceeds a certain energy level, even when the energy density is set constant and the beam diameter becomes large as distanced from the focal position, the line width does not become broad by performing printing with the central portion of a Gaussian distribution, whereby the line width having the same width as that obtained at the focal position can be obtained.

<<Image Erasing Step>>

When image recording is performed on the thermoreversible recording medium, there may be provided an image erasing step of heating the thermoreversible recording medium on which the image has been formed, to thereby erase the image recorded in the thermoreversible recording medium.

Examples of the method for heating the thermoreversible recording medium include conventionally known heating methods such as non-contact heating methods using laser beam irradiation, hot air, hot water, or an ultrared heater and contact heating methods using a thermal head, a hot stamp, a heat block or a heat roller. Considering use in logistic lines, the method of irradiating and heating the thermoreversible recording medium with laser beams is particularly preferable since image erasing can be performed in a non-contact manner.

In the image erasing step of irradiating and heating the thermoreversible recording medium with laser beams to erase the image therein, the output power of laser beams irradiated is not particularly limited and may be appropriately selected depending on the intended purpose. It is preferably 5 W or more, more preferably 7 W or more, still more preferably 10 W or more. When the output power of laser beams is less than 5 W, it takes a long time to perform image erasing. In an attempt to shorten the time required for image erasing, the output power becomes insufficient to cause erase failure of the image. The upper limit of the output power of laser beams is not particularly limited and may be appropriately selected depending on the intended purpose. It is preferably 200 W, more preferably 150 W, still more preferably 100 W. When the output power of laser beams exceeds 200 W, a large laser device has to be used in some cases.

In the image erasing step of irradiating and heating the thermoreversible recording medium with laser beams to erase the image therein, the scanning velocity of laser beams irradiated is not particularly limited and may be appropriately selected depending on the intended purpose. It is preferably 100 mm/s or more, more preferably 200 mm/s or more, still more preferably 300 mm/s or more. When the scanning velocity is less than 100 mm/s, it takes a long time to perform image erasing. The upper limit of the scanning velocity of laser beams is not particularly limited and may be appropriately selected depending on the intended purpose. It is preferably 20,000 mm/s, more preferably 15,000 mm/s, still more preferably 10,000 mm/s. When the scanning velocity exceeds 20,000 mm/s, the scanning velocity becomes difficult to control to make it difficult to perform uniform image erasing.

The laser beam source is preferably at least one selected from the group consisting of a YAG laser, a fiber laser and a laser diode.

In the image erasing step of irradiating and heating the thermoreversible recording medium with laser beams to erase the image therein, the spot diameter of laser beams irradiated is not particularly limited and may be appropriately selected depending on the intended purpose. It is preferably 0.5 mm or more, more preferably 1.0 mm or more, still more preferably 2.0 mm or more. The upper limit of the spot diameter of laser beams is not particularly limited and may be appropriately selected depending on the intended purpose. It is preferably 14.0 mm, more preferably 10.0 mm, still more preferably 7.0 mm.

When the spot diameter is small, it takes a long time to perform image erasing. Whereas when the spot diameter is large, the output power becomes insufficient to cause erase failure of the image.

<Medium>

In the present invention, in order for the image-recorded medium to absorb laser beams with high efficiency, it is necessary to select the wavelength of the laser beams emitted. For example, the thermoreversible recording medium used in the present invention contains at least a light heat converting material which plays a role in absorbing laser beams with high efficiency and generating heat. Thus, the wavelength of the laser beams emitted has to be selected so that the light heat converting material contained absorbs the selected laser beams to a larger extent than the other materials do.

<<Thermoreversible Recording Medium>>

The thermoreversible recording medium includes: a support; a first thermoreversible recording layer; a light heat converting layer; and a second thermoreversible recording layer, where the first thermoreversible recording layer, the light heat converting layer and the second thermoreversible recording layer are disposed on the support in this order. If necessary, the thermoreversible recording medium further includes appropriately selected other layers such as a first oxygen barrier layer, a second oxygen barrier layer, a UV ray absorption layer, a back layer, a protective layer, an intermediate layer, an undercoat layer, an adhesive layer, a tacky layer, a colored layer, an air layer and a light reflection layer. Each of these layers may have a single-layered structure or a multi-layered structure. For the purpose of reduce energy loss of irradiated laser beam having a specific wavelength, the layers provided on or above the light heat converting layer are preferably formed of materials that absorb light of the specific wavelength in a small amount.

Figure 3A:
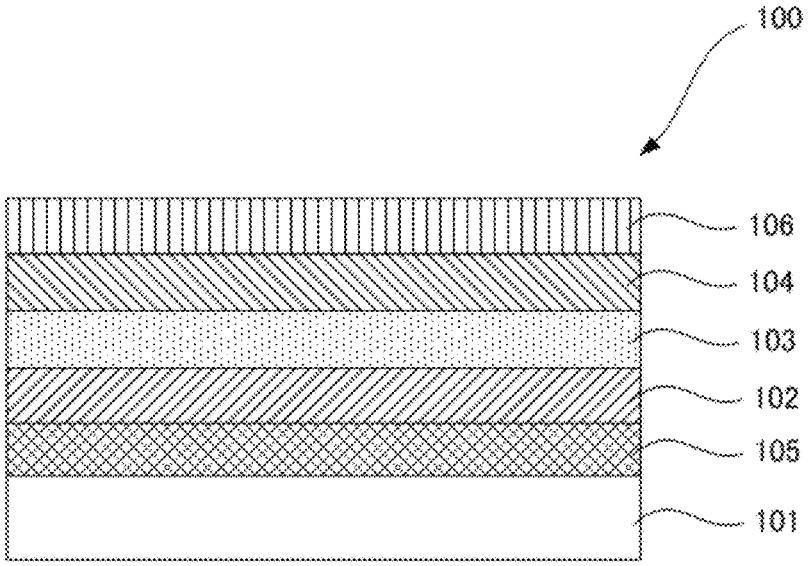
FIG. 3A is a schematic cross-sectional view of one exemplary layer structure of a thermoreversible recording medium.
Figure 3B:
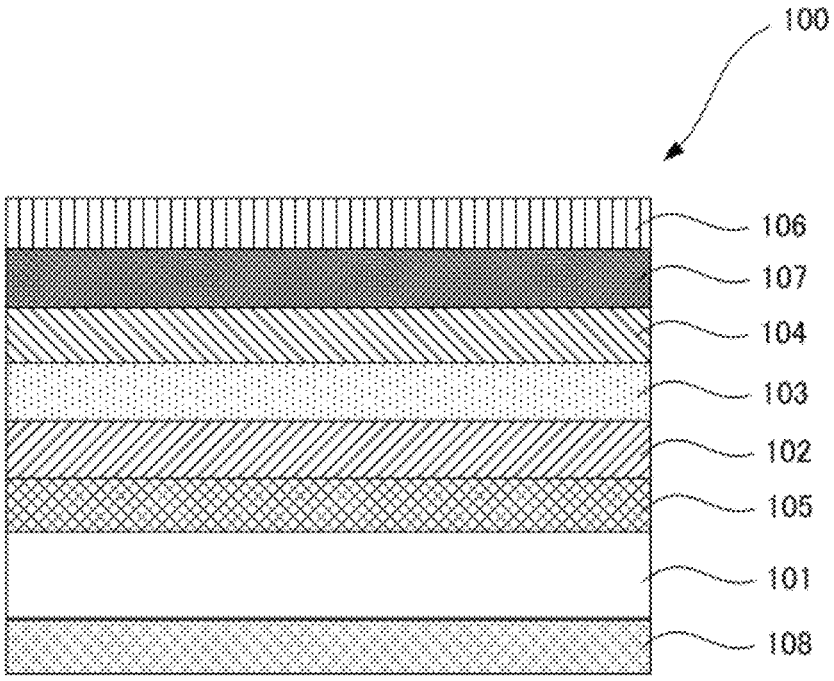
FIG. 3B is a schematic cross-sectional view of another exemplary layer structure of a thermoreversible recording medium.
Figure 3C:
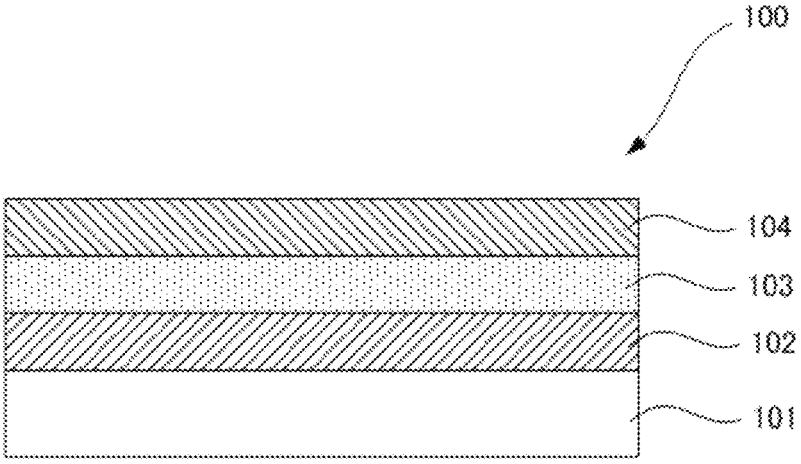
FIG. 3C is a schematic cross-sectional view of still another exemplary layer structure of a thermoreversible recording medium.

Here, as illustrated in FIG. 3C, the thermoreversible recording medium 100 has a layer structure containing a support 101, a first thermoreversible recording layer 102, a light heat converting layer 103, a second thermoreversible recording layer 104 which are provided on the support in this order.

Also, as illustrated in FIG. 3A, the thermoreversible recording medium 100 has another layer structure containing a support 101, a first oxygen barrier layer 105, a first thermoreversible recording layer 102, a light heat converting layer 103, a second thermoreversible recording layer 104 and a second oxygen barrier layer 106 which are provided on the support.

Also, as illustrated in FIG. 3B, the thermoreversible recording medium 100 has still another layer structure containing a support 101, a first oxygen barrier layer 105, a first thermoreversible recording layer 102, a light heat converting layer 103, a second thermoreversible recording layer 104, a UV ray absorption layer 107, a second oxygen barrier layer 106, which are provided on the support, and a back layer 108, which is provided on the surface of the support 101 where the thermoreversible recording layers are not provided.

Notably, a protective layer may be formed as the uppermost surface layer on the second thermoreversible recording layer 104 illustrated in FIG. 3A, on the second oxygen barrier layer 106 illustrated in FIG. 3B, or on the second oxygen barrier layer 106 illustrated in FIG. 3C.

—Support—

The shape, structure and size of the support are not particularly limited and may be appropriately selected depending on the intended purpose. Examples of the shape include a tabular shape, and the structure may be a single-layered structure or a multi-layered structure, and the size can be appropriately selected according to the size of the thermoreversible recording medium.

Examples of the material of the support include inorganic material and organic material.

Examples of the inorganic material include glass, quartz, silicon, silicon oxide, aluminum oxide, $SiO_2$, and metals.

Examples of the organic material include paper, cellulose derivatives such as cellulose triacetate, synthetic paper, and films of polyethylene terephthalates, polycarbonates, polystyrenes, and polymethyl methacrylates.

These inorganic or organic materials may be used alone or in combination. Among them, films of polyethylene terephthalates, polycarbonates, and polymethyl methacrylates are preferred, and films of polyethylene terephthalates are particularly preferred.

In order for the support to have improved adhesiveness to a layer coated thereon, it is preferably subjected to surface modification by, for example, a corona discharge treatment, an oxidation treatment (using, for example, chromic acid), an etching treatment, an easy-adhesion treatment and an antistatic treatment.

The support is preferably whitened by incorporating a white pigment (e.g., titanium oxide) thereinto.

The thickness of the support is not particularly limited and may be appropriately selected depending on the intended purpose. Preferably, it is 10 μm to 2,000 μm, more preferably 50 μm to 1,000 μm.

—First and Second Thermoreversible Recording Layers—

The first and second thermoreversible recording layers (hereinafter may be referred to as "thermoreversible recording layer") each contain leuco dye, which is an electron-donating coloring compound, and a color developer which is an electron-accepting compound and are a thermoreversible recording layer which reversibly changes in color by heat; if necessary, further contain other ingredients such as a binder resin.

The leuco dye (electron-donating coloring compound) and the reversible color developer (electron-accepting compound) which reversibly changes in color by heat are materials capable of reversibly causing visible changes depending on a change in temperature. These materials can turn into a relatively color-developed state or a relatively color-erased state depending on the heating temperature and on the cooling rate after heating.

—Leuco Dye—

The leuco dye itself is a colorless or light-colored dye precursor. The leuco dye is not particularly limited and may be appropriately selected from those known in the art. Preferred examples thereof include leuco compounds such as triphenylmethanephthalides, triallylmethanes, fluorans, phenothiazines, thiofluorans, xanthenes, indophthalyls, spiropyrans, azaphthalides, chromenopyrazoles, methines, rhodamineanilinolactams, rhodaminelactams, quinazolines, diazaxanthenes and bislactones. Among them, fluoran leuco dyes and phthalide leuco dyes are particularly preferred since they are excellent in, for example, color developing/erasing properties, color hue, and storage stability. These compounds may be used alone or in combination. Also, reversible thermosensitive recording media assuming multi-color or full-color may also be produced by laminating layers capable of developing colors having different colors.

—Reversible Color Developer—

The reversible color developer is not particularly limited and may be appropriately selected depending on the intended purpose, so long as it can reversibly develop and erase color by the action of heat. Examples thereof include compounds having in the molecule one or more of a structure selected from (1) a structure allowing the leuco dye to develop color (e.g., a phenolic hydroxyl group, a carboxyl group and a phosphoric acid group) and (2) a structure controlling intermolecular aggregation force (e.g., a structure linked with a long chain hydrocarbon group). Notably, the linking moiety in the above structure may have a hetero atom-containing di- or more valent linking group and also, the long chain hydrocarbon group may contain the same linking group, an aromatic group, or both of them.

The structure (1) allowing the leuco dye to develop color is particularly preferably phenol.

The structure (2) controlling intermolecular aggregation force is preferably a long chain hydrocarbon group having 8 or more carbon atoms, more preferably 11 or more carbon atoms, where the upper limit of the number of carbon atoms is preferably 40, more preferably 30.

The reversible color developer is preferably a phenol compound represented by the following General Formula (1), more preferably a phenol compound represented by the following General Formula (2).

General Formula (1)

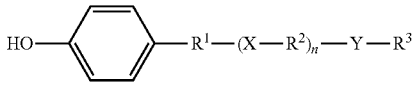

General Formula (2)

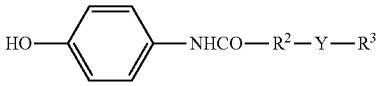

In General Formulas (1) and (2), $R^1$ represents a single bond or an aliphatic hydrocarbon group having 1 to 24 carbon atoms, $R^2$ represents an aliphatic hydrocarbon group which may have a substituent and has 2 or more carbon atoms, preferably 5 or more carbon atoms, more preferably 10 or more carbon atoms, and $R^3$ represents an aliphatic hydrocarbon group having 1 to 35 carbon atoms, preferably 6 to 35 carbon atoms, more preferably 8 to 35 carbon atoms. These aliphatic hydrocarbon groups may be used alone or in combination.

The total number of the carbon atoms contained in $R^1$, $R^2$ and $R^3$ is not particularly limited and may be appropriately selected depending on the intended purpose. The lower limit of the total number is preferably 8, more preferably 11, and the upper limit of the total number is preferably 40, more preferably 35.

When the total number of the carbon atoms is less than 8, stability of color development and color eraseability may be degraded.

The aliphatic hydrocarbon group may be linear or branched or may have an unsaturated bond, but is preferably linear. Examples of the substituent the above hydrocarbon groups have include a hydroxyl group hydroxyl group, a halogen atom and an alkoxy group.

X and Y may be the same or different and each represent a N or O atom-containing divalent group. Examples of the group include an oxygen atom, an amide group, a urea group, a diacylhydrazine group, an oxalic acid diamide group, an acylurea group, with an amide group and a urea group being preferred.

n is an integer of 0 or 1.

The electron-accepting compound (color developer) is preferably used in combination with a color erasure accelerator which is a compound having in the molecule one or more —NHCO— groups and/or —OCONH— groups, since an intermolecular interaction is induced between the color erasure accelerator and the developer in the process of forming the erased state, making it possible to improve color developing/erasing properties.

The color erasure accelerator is not particularly limited and may be appropriately selected depending on the intended purpose.

If necessary, the thermoreversible recording layer may contain various additives which are used to improve and control coating characteristics and color development/erasure properties of the thermoreversible recording layer. Examples of the additives include surfactants, electrical conducting agents, fillers, antioxidants, photostabilizers, color development stabilizers, and crosslinking accelerators.

—Binder Resin—

The binder resin is not particularly limited and may be appropriately selected depending on the intended purpose, so long as it can bind the thermoreversible recording layer onto the support. Conventionally known resins may be used alone or in combination. In order to improve durability after repetitive use, there are preferably used resins curable by heat, ultraviolet rays or electron beams. In particular, thermsetting resins using an isocyanate compound as a crosslinking agent are preferred. Examples of the thermsetting resin include resins having a group reactive with a crosslinking agent (e.g., a hydroxyl group or a carboxyl group) and resins obtained by copolymerizing a monomer containing a hydroxyl group or a carboxyl group and another monomer. Specific examples of the thermsetting resin include phenoxy resins, polyvinylbutyral resins, cellulose acetate propionate resins, acrylpolyol resins, polyester polyol resins, and polyurethane polyol resins. Among them, particularly preferred are acrylpolyol resins, polyester polyol resins and polyurethane polyol resins.

The mixing ratio (by mass) of the leuco dye and the binder resin in the thermoreversible recording layer is preferably 1 (leuco dye): 0.1 to 10 (binder resin). When the amount of the binder resin is too small, the heat intensity of the thermoreversible recording layer may be insufficient. Whereas when the amount of the binder resin is too large, the density of developed color may problematically decrease.

The crosslinking agent is not particularly limited and may be appropriately selected depending on the intended purpose. Examples thereof include isocyanates, amino resins, phenol resins, amines and epoxy compounds, with isocyanates being preferred, with polyisocyanate compound each having two or more isocyanate groups being particularly preferred.

Regarding the amount of the crosslinking agent added to the binder resin, the ratio of the number of functional groups contained in the crosslinking agent to the number of active groups contained in the binder resin is preferably 0.01 to 2. When this ratio is less than 0.01, the heat intensity may be insufficient. Whereas when it is more than 2, color development/erasure properties may be adversely affected.

A catalyst used in this type of reaction may be used as the crosslinking accelerating agent.

The thermally crosslinked thermsetting resin preferably has a gel fraction of 30% or more, more preferably 50% or more, further preferably 70% or more. When the gel fraction is less than 30%, the cosslinked state is not sufficient to potentially lead to poor durability.

Whether the binder resin is in the crosslinked state or the non-crosslinked state can be confirmed by, for example, immersing the coating film in a solvent having high dissolution capability. In case of the binder resin in the non-crosslinked state, the resin begins to dissolve in the solvent and does not remain in the solute.

The other ingredients of the thermoreversible recording layer are not particularly limited and may be appropriately selected depending on the intended purpose. Examples thereof surfactants and plasticizers, which facilitate image recording.

The solvents used for preparing a coating liquid for the thermoreversible recording layer, dispersing devices for the coating liquid, coating methods, and drying/curing methods may be those known in the art. Note that the coating liquid for the thermoreversible recording layer may be prepared by separately dissolving the ingredients in a solvent using the dispersing device; or may be prepared by separately dissolving the ingredients in separate solvents, followed by mixing of the resultant solutions. In addition, the ingredients may be dissolved in the coating liquid by heating and precipitated by rapid or gradual cooling.

The method for forming the thermoreversible recording layer is not particularly limited and may be appropriately selected depending on the intended purpose. Preferred examples thereof include: (1) a method in which a support is coated with a thermoreversible recording layer-coating liquid prepared by dissolving or dispersing in a solvent the resin, the leuco dye and the reversible color developer, and then the solvent is evaporated to form a sheet in parallel with or before crosslinking; (2) a method in which only the resin is dissolved in a solvent, then the leuco dye and the reversible color developer are dispersed in the resultant solution to prepare a thermoreversible recording layer-coating liquid, then the thus-prepared coating liquid is applied onto a support, and then the solvent is evaporated to form a sheet in parallel with or before crosslinking; and (3) a method in which the resin, the leuco dye and the reversible color developer are mixed with one another through melting without using a solvent, and then the thus-melted mixture is formed into a sheet, followed by cooling and crosslinking. In these methods, it is also possible to form the coating liquid into a sheet-shaped thermoreversible recording medium without using a support.

The solvent used in the method (1) or (2) varies depending on the types of the resin, the leuco dye and the reversible color developer and can not flatly be determined. Examples thereof include tetrahydrofuran, methyl ethyl ketone, methyl isobutyl ketone, chloroform, carbon tetrachloride, ethanol, toluene and benzene.

Notably, the reversible color developer is dispersed in the form of particles in the thermoreversible recording layer.

Also, in order for the thermoreversible recording layer-coating liquid to exhibit high performances suited for a coating material, various pigments, defoamers, pigments, dispersants, slipping agents, antiseptics, crosslinking agents and plasticizers may be added thereto.

The method for applying the thermoreversible recording layer-coating liquid is not particularly limited and may be appropriately selected depending on the intended purpose. For example, while a roll-shaped support is continuously conveyed, the coating liquid is applied on the support by known coating methods such as blade coating, wire bar coating, spray coating, air knife coating, bead coating, curtain coating, gravure coating, kiss coating, reverse roll coating, dip coating and die coating. Alternatively, a support is previously cut into sheets, and then while the sheets are conveyed, the coating liquid is applied on the sheets by the above coating method.

The drying conditions for the thermoreversible recording layer-coating liquid are not particularly limited and may be appropriately determined depending on the intended purpose. For example, the coating liquid is dried at room temperature to 140° C. for about 10 sec to about 10 min The thickness of the thermoreversible recording layer is not particularly limited and may be appropriately selected depending on the intended purpose. For example, it is 1 μm to 20 μm, more preferably 3 μm to 15 μm. When the thickness of the thermoreversible recording layer is too small, the density of developed color decreases and thus, image contrast of the formed image may be lowered. Whereas when the thickness of the thermoreversible recording layer is too large, thermal distribution becomes broad in the layer. Thus, some portions do not reach a color developing temperature and cannot develop color, potentially resulting in failure to attain a desired color density.

—Light Heat Converting Layer—

The light heat converting layer contains at least a light heat converting material which has a role in generating heat by absorbing laser beam with high absorption rate. Also, a barrier layer may be formed between the thermoreversible recording layer and the light heat converting layer for the purpose of preventing the interaction of these layers. The barrier layer is preferably made of a material having high thermal conductivity. The layers provided between the thermoreversible recording layer and the light heat converting layer are appropriately selected depending on the intended purpose and are not limited to the barrier layer.

The light heat converting material can be roughly classified into inorganic materials and organic materials.

Examples of the inorganic materials include carbon black, metals such as Ge, Bi, In, Te, Se and Cr, semimetals or alloys containing them, and these are formed into a layer by vacuum evaporation, or bonding together particulate materials with resin.

Various dyes may suitably be used as the organic materials depending on the wavelength of light to be absorbed, and when a laser diode is used as a light source, near-infrared absorbing dyes having an absorption peak in the range of 700 nm to 1,500 nm are used. Specific examples thereof include cyanine dyes, quinine dyes, quinoline derivatives of indonaphthol, phenylenediamine nickel complexes and phthalocyanine compounds. It is preferable to select a light heat converting material which offers excellent heat resistance because cycles of printing and erasing can be repeated. In terms of this, phthalocyanine compounds are particularly preferred.

The near-infrared absorbing dyes may be used alone or in combination.

When the light heat converting layer is provided, the light heat converting material is generally used in combination with a resin. The resin used in the light heat converting layer is not particularly limited and may be appropriately selected from those known in the art, so long as it can retain the inorganic material and the organic material. Thermoplastic resins and thermsetting resins are preferably used as the resin. Similar resins to the binder resins used in the thermoreversible recording layer can suitably used. Among them, in order to improve durability to repeated printing, resin curable with, for example, heat, UV rays or electronic beams are preferably used. In particular, there are preferably used thermally curable resins using an isocyanate compound as a crosslinking agent. The resin (binder resin) preferably has a hydroxyl value of 50 mgKOH/g to 400 mgKOH/g.

The thickness of the light heat converting layer is not particularly limited and may be appropriately selected depending on the intended purpose. It is preferably 0.1 μm to 20 μm.

—First and Second Oxygen Barrier Layers—

The first and second oxygen barrier layers are provided for preventing oxygen from entering the thermoreversible recording layer. In order to prevent the leuco dye contained in the first and second thermoreversible recording layers from being degraded by light, oxygen barrier layer are preferably provided so as to sandwich the first and second thermoreversible recording layers. That is, a first oxygen barrier layer is provided between the support and the first thermoreversible recording layer, and a second oxygen barrier layer is provided over the second thermoreversible recording layer.

The first or second oxygen barrier layer is, for example, a polymer film having high transmittance with respect to light of the visible region and low oxygen permeability. The oxygen barrier layer is appropriately selected in consideration of its application, oxygen permeability, transparency, coatability and adhesion property. Specific examples of the oxygen barrier layer includes films made of resins such as polyalkyl acrylates, polyalkyl methacrylates, polymethacylonitriles, polyalkylvinyl esters, polyalkylvinyl ethers, polyvinyl fluorides, polystyrenes, vinyl acetate copolymers, cellulose acetate, polyvinyl alcohols, polyvinyliden chlorides, acetonitrile copolymers, vinylidene chloride copolymers, poly(chlorotrifluoroethylene), ethylene-vinyl alcohol copolymers, polyacrylonitriles, acrylonitrile copolymers, polyethylene terephthalates, Nylon-6 and polyacetals; and silica vapor deposition films, alumina vapor deposition films, and silica/alumina vapor deposition films obtained by vapor-depositing inorganic oxides on a polymer film made of, for example, polyethylene terephthalate and Nylon. Among them, particularly preferred are films obtained by vapor-depositing inorganic oxides on a polymer film.

The oxygen permeability of the oxygen barrier layer is preferably 20 $mL/m^2/day/MPa$ or lower, more preferably 5 $mL/m^2/day/MPa$ or lower, still more preferably 1 $mL/m^2/day/MPa$ or lower. When the oxygen permeability is higher than 20 $mL/m^2/day/MPa$, there may be a case where the degradation of the leuco dye contained in the first and second thermoreversible recording layers cannot be prevented.

The oxygen permeability can be measured by a measuring method according to, for example, JIS K7126 Method B.

Alternatively, the oxygen barrier layers may be provided under the thermoreversible recording layer or on the back surface of the support so as to sandwich the thermoreversible recording layers. Provision of the oxygen barrier layers in such a manner can effectively prevent oxygen from entering the thermoreversible recording layers to reduce degradation of the leuco dye due to light.

The method for forming the first or second oxygen barrier layer is not particularly limited and may be appropriately selected depending on the intended purpose. Examples thereof include a melt-extrusion method, a coating method and a laminate method.

The thickness of the first or second oxygen barrier layer varies with the oxygen permeability of the resin or polymer film, but is preferably 0.1 μm to 100 μm. When it is smaller than 0.1 μm, the oxygen barrier obtained is not complete. When it is larger than 100 μm, the transparency decreases, which is not preferred.

An adhesive layer may be provided between the oxygen barrier layer and the underlying layer. The method for forming the adhesive layer is not particularly limited and may be appropriately selected depending on the intended purpose. Examples thereof include commonly used coating methods and laminate methods. The thickness of the adhesive layer is not particularly limited and may be appropriately selected depending on the intended purpose, but is preferably 0.1 μm to 5 μm. The adhesive layer may be cured with a crosslinking agent. Crosslinking agents that are similar to those used for forming the thermoreversible recording layer are suitably used as the crosslinking agent.

—Protective Layer—

It is preferable to provide a protective layer on the thermoreversible recording layer for the purpose of protecting the thermoreversible recording layer. The protective layer is not particularly limited and may be selected appropriately selected depending on the intended purpose, but is preferably formed as one or more layers on the exposed uppermost surface.

The protective layer contains a binder resin; and, if necessary, further contains other ingredients such as a filler, a lubricant and/or a coloring pigment.

The binder resin used for the protective layer is not particularly limited and may be appropriately selected depending on the intended purpose. Preferred examples thereof include thermosetting resins, UV-curable resins, and electron beam-curable resins. Of these, UV-curable resins and thermosetting resins are particularly preferred.

Since UV-curable resins can form very hard films after being cured and can prevent surface damage due to physical contact and/or deformation of media by laser heating, it is possible to provide a thermoreversible recording medium with excellent durability to repeated printing.

Similarly thermosetting resins can harden a surface, though their hardening capability is slightly lower than that of UV-curable resins, and can provide a thermoreversible recording medium of excellent durability to repeated printing.

The UV-curable resins are not particularly limited and may be appropriately selected from those known in the art depending on the intended purpose. Examples thereof include oligomers of urethane acrylates, epoxy acrylates, polyester acrylates, polyether acrylates, vinyls and unsaturated polyesters; and monomers of various monofunctional or polyfunctional acrylates, methacrylates, vinyl esters, ethylene derivatives and allyl compounds. Of these, polyfunctional monomers or oligomers of tetrafunctional or more are particularly preferred. By mixing two or more types of these monomers or oligomers, hardness, degree of shrinkage, flexibility and/or strength of a coating film can be adjusted appropriately. In order to cure the foregoing monomer or oligomer by irradiation with ultraviolet rays, it is necessary to use a photopolymerization initiator and/or a photopolymerization accelerator.

The amount of the photopolymerization initiator or the photopolymerization accelerator is preferably 0.1% by mass to 20% by mass, more preferably 1% by mass to 10% by mass, relative to the total mass of the resin components of the protective layer.

Ultraviolet irradiation for curing the UV-curable resin can be performed using any of known ultraviolet irradiation devices, and examples thereof include those equipped with, for example, a light source, a lamp fitting, an electric power source, a cooling device and a carrying device.

Examples of the light source include a mercury lamp, a metal halide lamp, a potassium lamp, a mercury xenon lamp, and a flash lamp. The wavelength of light emitted from the light source may be appropriately selected depending on the UV absorption wavelengths of the photopolymerization initiator and photopolymerization accelerator added to the composition for forming the thermoreversible recording medium.

The conditions used for UV irradiation are not particularly limited and may be appropriately selected depending on the intended purpose. The power of the lamp output and light-propagation rate may be appropriately determined according to the irradiation energy needed to crosslink the resin.

Moreover, for the purpose of improving transportability of the media, a releasing agent such as a polymerizable group-containing silicone, silicone-grafted polymer, wax, or zinc stearate, and/or a lubricant such as silicone oil may be added to the protective layer. The amount of these agents added is preferably 0.01% by mass to 50% by mass, more preferably 0.1% by mass to 40% by mass, relative to the total amount of the resin components of the protective layer. These agents may be used alone or in combination. Moreover, in order to remove static electricity, it is preferable to use an electrically conductive filler, more preferably a needle-shaped electrically conductive filler.

The particle diameter of the inorganic pigment preferably ranges from 0.01 μm to 10.0 μm, more preferably 0.05 μm to 8.0 μm. The inorganic pigment is preferably added in an amount of 0.001 parts by mass to 2 parts by mass, more preferably 0.005 parts by mass to 1 part by mass, per 1 part by mass of the heat resistant resin.

The protective layer may contain additive(s) such as conventionally known surfactants, leveling agents, and/or antistatic agents.

The thermosetting resins may be resins similar to the binder resins used in the thermoreversible recording layer.

It is preferable that the thermosetting resins be crosslinked. Therefore, it is preferable to employ thermosetting resins having a group that reacts with a curing agent, such as a hydroxyl group, an amino group, and a carboxylic group. In particular, polymers having a hydroxyl group(s) are preferred. In order to increase the layer containing such polymer that has a UV absorption structure, the thermosetting resins preferably have a hydroxyl value of 10 mgKOH/g or more for sufficient strength of the coating film, more preferably 30 mgKOH/g or more, further preferably 40 mgKOH/g or more. By imparting sufficient strength to the coating film, degradation of the thermoreversible recording medium can be suppressed even after repeated image formation and image erasing.

Preferred examples of the curing agents include those similar to the curing agents used for the thermoreversible recording layer.

The solvents for preparing the coating liquid of the protective layer, dispersing devices for preparing the coating liquid for the protective layer, the coating method, and the drying method may be those known in the art employed for forming the thermoreversible recording layer. When a UV-curable resin is used, a curing step is necessary after application and drying of the coating liquid for the protective layer. The UV irradiation device, light source, and irradiation conditions are as described above.

The thickness of the protective layer is preferably 0.1 μm to 20 μm, more preferably 0.5 μm to 10 μm, further preferably 1.5 μm to 6 μm. When the thickness thereof is less than 0.1 μm, the function as a protective layer of the thermoreversible recording medium cannot be fully exerted and the medium is susceptible to heat repeatedly applied, which may unable the medium to be used repeatedly. When the thickness thereof is greater than 20 μm, it results in failure to transmit sufficient heat to the recording layer underlying the protective layer, which may in turn make image printing or erasing by heat impossible.

—UV Ray Absorption Layer—

In the present invention, in order to prevent the leuco dye in the thermoreversible recording layer from suffering coloring due to UV rays and incomplete decolorization resulting from degradation due to light, a UV ray absorption layer is preferably provided on a surface of the support where the thermoreversible recording layer is not provided. Provision of the UV ray absorption layer can improve the thermoreversible recording medium in light resistance. In order for the UV ray absorption layer to absorb UV rays having a wavelength of 390 nm or shorter, the thickness of the UV ray absorption layer is appropriately selected.

The UV ray absorption layer contains at least a binder resin and a UV ray absorber; and, if necessary, further contains other ingredients such as filler, a lubricant and a colored pigment.

The binder resin is not particularly limited and may be appropriately selected depending on the intended purpose. It may be the binder resin of the thermoreversible recording layer, or a resin such as a thermoplastic resin or a thermsetting resin. Examples of the binder resin include polyethylenes, polypropylenes, polystyrenes, polyvinyl alcohols, polyvinyl butyrals, polyurethanes, saturated polyesters, unsaturated polyesters, epoxy resins, phenol resins, polycarbonates and polyamides.

The UV ray absorber may be an organic or inorganic compound.

It is preferably a polymer having a UV ray absorbing structure (hereinafter may be referred to as "UV ray absorbing polymer").

Here, the polymer having a UV ray absorbing structure refers to a polymer having in the molecule a UV ray absorbing structure (e.g., a UV ray absorbing group). Examples of the UV ray absorbing structure include a salycylate structure, a cyanoacrylate structure, a benzotriazole structure, and a benzophenone structure. Among them, a benzotriazole structure and a benzophenone structure are particularly preferred since they absorb UV rays having a wavelength of 340 nm to 400 nm which degrade the leuco dye.

The UV ray absorbing polymer is preferably crosslinked. Thus, the UV ray absorbing polymer preferably has a group reactive with a curing agent, such as a hydroxyl group, an amino group and/or a carboxyl group, particularly preferably has a hydroxyl group. In order to increase the strength of a layer containing the UV ray absorbing polymer to obtain a sufficiently strong layer, the UV ray absorbing polymer to be used preferably has a hydroxyl value of 10 mgKOH/g or more, more preferably 30 mgKOH/g or more, still more preferably 40 mgKOH/g or more. Such sufficiently strong layer can prevent the recording medium from being degraded even after repeated erasing and printing.

The thickness of the UV ray absorption layer is 0.1 μm to 30 μm, more preferably 0.5 μm to 20 μm. The solvents for preparing the coating liquid of the UV ray absorption layer, dispersing devices for preparing the coating liquid of the UV ray absorption layer, the coating method and the drying method for the UV ray absorption layer, and the drying and curing method for the UV ray absorption layer may be those known in the art employed for forming the thermoreversible recording layer.

—Intermediate Layer—

In the present invention, an intermediate layer is preferably disposed between the thermoreversible recording layer and the protective layer, for the purposes of improving adhesion properties between the thermoreversible recording layer and the protective layer, preventing degeneration of the thermoreversible recording layer due to application of the protective layer thereon, and preventing the additives in the protective layer from transferring into the recording layer. Provision of the intermediate layer can improve storage stability of a color-developed image.

The intermediate layer contains at least a binder resin and further contains other ingredient(s) such as a filler, a lubricant and/or a coloring pigment if necessary.

The binder resin is not particularly limited and may be appropriately selected depending on the intended purpose, and resins used for the thermoreversible recording layer, thermoplastic resins and thermosetting resins may be used. Examples of the resins include polyethylene, polypropylene, polystyrene, polyvinylalcohol, polyvinylbutyral, polyurethane, saturated polyesters, unsaturated polyesters, epoxy resins, phenol resins, polycarbonates, and polyamides.

Preferably, the intermediate layer contains a UV-absorbing agent. The UV-absorbing agent may be either an organic compound or an inorganic compound.

Moreover, UV-absorbing polymers may be used, and may be cured by a crosslinking agent. These UV-absorbing polymers may be the same as employed in the above protective layer.

The thickness of the intermediate layer is preferably 0.1 μm to 20 μm, more preferably 0.5 μm to 5 μm. The solvents for preparing the coating liquid of the intermediate layer, dispersing devices for preparing the coating liquid of the intermediate layer, the coating method, and the drying method for the intermediate layer may be those known in the art employed for forming the thermoreversible recording layer.

—Under Layer—

In the present invention, the under layer may be disposed between the thermoreversible recording layer and the support, for the purposes of achieving high sensitivity by efficiently utilizing heat applied, improving adhesion properties between the support and the thermoreversible recording layer, and preventing infiltration of the thermoreversible recording layer's materials into the support.

The under layer contains at least hollow particles, and contains a binder resin and, if necessary, contains other ingredient(s).

Examples of the hollow particles include single-hollow particles each having one void therein, and multiple-hollow particles each having a plurality of voids therein. These hollow particles may be used alone or in combination.

Materials of the hollow particles are not particularly limited and may be appropriately selected depending on the intended purpose, and preferred examples thereof include thermoplastic resins. The hollow particles may be prepared as needed or may be a commercially available product. Examples of the commercially available product include MICROSPHERE R-300 (product of Matsumoto Yushi-Seiyaku Co., Ltd.), LOPAKE HP1055 and LOPAKE HP433J (these products are of Zeon Corp) and SX866 (product of JSR Corp).

The amount of the hollow particles added to the under layer is not particularly limited and may be appropriately selected depending on the intended purpose. It is preferably 10% by mass to 80% by mass.

The binder resin for hollow particles may be the same binder resins used for the preparation of the thermoreversible recording layer or the layer containing a polymer having a UV-absorbing structure.

At least one of an inorganic filler (e.g., calcium carbonate, magnesium carbonate, titanium oxide, silicon oxide, aluminum hydroxide, kaolin, or talc) and an organic filler of various types may be contained in the under layer.

Additional additive(s) such as a lubricant, a surfactant, and/or a dispersing agent may be contained in the under layer.

The thickness of the under layer is not particularly limited and may be appropriately selected depending on the intended purpose, but is preferably 0.1 μm to 50 μm, more preferably 2 μm to 30 μm, further preferably 12 μm to 24 μm.

—Back Layer—

In the present invention, a back layer may be disposed on a side of the support which is opposite to the side on which the thermoreversible recording layer is to be disposed, for the purposes of preventing curling or electrical charging of the thermoreversible recording medium and improving transferability.

The back layer contains at least a binder resin and, if necessary, further contains additional ingredient(s) such as a filler, a electroconductive filler, a lubricant and/or a coloring pigment.

The binder resin for the back layer is not particularly limited and may be appropriately selected depending on the intended purpose, and examples thereof include thermosetting resins, ultraviolet ray (UV)-curable resins, and electron beam-curable resins. Of these, UV-curable resins and thermosetting resins are particularly preferred.

UV-curable resins, thermosetting resins, fillers, electroconductive fillers, and lubricants that are similar to those used for the thermoreversible recording layer or the protective layer can suitably be used for the preparation of the back layer.

—Adhesion Layer and Sticking Layer—

It is possible to provide a thermoreversible recording label by disposing an adhesion layer or sticking layer on a side of the support where the recording layer is not formed. General materials can be used to prepare the adhesion layer or sticking layer.

The materials for the adhesion layer or sticking layer are not particularly limited and may be appropriately selected depending on the intended purpose. Examples of the materials include urea resins, melamine resins, phenol resins, epoxy resins, vinyl acetate resins, vinyl acetate-acrylic copolymers, ethylene-vinyl acetate copolymers, acrylic resins, polyvinylether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubbers, cyanoacrylate resins, and silicone resins.

The materials for the adhesive layer or the sticking layer may be of hot-melt type. Release paper may also be used or it may be of non-release paper type. By disposing the adhesive layer or the sticking layer as described above, the recording layer can be attached to the entire or part of the surface of a thick substrate like a vinyl chloride card with magnetic stripes, where it is difficult to form a recording layer thereon. This improves convenience of the thermoreversible recording medium, e.g., a part of magnetically stored information can be displayed. The thermoreversible recording label to which such adhesive layer or sticking layer is disposed is suitable for thick cards such as IC cards and optical cards.

A coloring layer may be disposed between the support and the recording layer of the thermoreversible recording medium for the purpose of improving visibility. The coloring layer may be formed by applying on a target surface a solution or dispersion liquid containing a coloring agent and a binder resin followed by drying, or by simply attaching a colored sheet to the target surface.

It is also possible to provide the thermoreversible recording medium with a color printing layer. Examples of the coloring agent in the color printing layer include various types of dyes and pigments contained in color inks used for conventional full-color print. Examples of the binder resin include various thermoplastic resins, thermosetting resins, UV-curable resins and electron beam-curable resins. The thickness of the color printing layer is not particularly limited, and because it may vary appropriately depending on the print color density, the thickness may be selected according to the desired print color density.

The thermoreversible recording medium may have a non-reversible recording layer in combination. The developed color tone of each recording layer may be identical or different. Furthermore, coloring layers on which arbitrary pictures are formed by printing such as offset printing and gravure printing or by inkjet printers, thermtransfer printers and dye sublimation printers on part or entire surface of the same side or part of the opposite side of the recording layer in the thermoreversible recording medium. Furthermore, an OP varnish layer, which contains a curable resin as a main component, may be disposed on part or entire surface of the coloring layer. Examples of the pictures include characters, patterns, drawing patterns, photographs and information detectable by infrared rays. Moreover, any of the constituent layers may be colored by simply adding thereto dye or pigment.

Furthermore, holograms may be provided in the thermoreversible recording medium for security purposes. And designs such as figures, company symbols and symbol marks, etc. may be disposed by forming convexes and concaves in a relief form or intaglio form for provision of industrial design.

The thermoreversible recording medium can be formed into desired form depending on its applications and may be formed into card form, tag form, label form, sheet form and roll form, for example. The thermoreversible recording medium formed into card form can be applied to, for example, prepaid cards, point cards, and credit cards. In addition, the thermoreversible recording medium in tag form, which is smaller than card form, can be applied to price tags, and the thermoreversible recording medium in tag form, which is larger than card form, may be applied to process management, shipping instruction and ticket. The thermoreversible recording medium in label form may be processed to have various sizes and used for process management or material management by sticking to trucks, containers, boxes and bulk containers which are used repeatedly. Moreover, because the thermoreversible recording medium of sheet size, which is larger than card size, allows wider print range, it is usable for general documents or instructions for process management.

<Mechanism of Image Recording or Erasing>

In the present invention, the mechanism of image recording or erasing is a mechanism in which color tone reversibly changes by the action of heat. This mechanism is achieved with a leuco dye and a reversible developer (hereinafter may be referred to as "color developer") where color tone reversibly changes between transparent state and color developing state by heating.

Figure 4A:
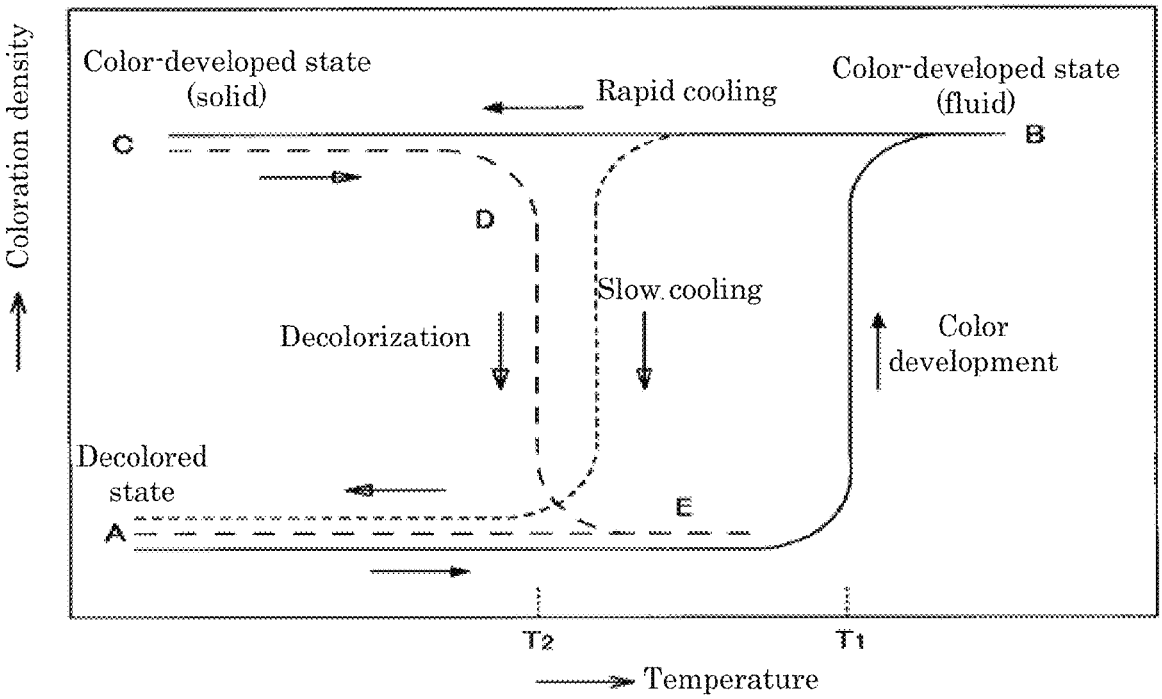
FIG. 4A is a graph indicating color developing and erasing characteristics of a thermoreversible recording medium.
Figure 4B:
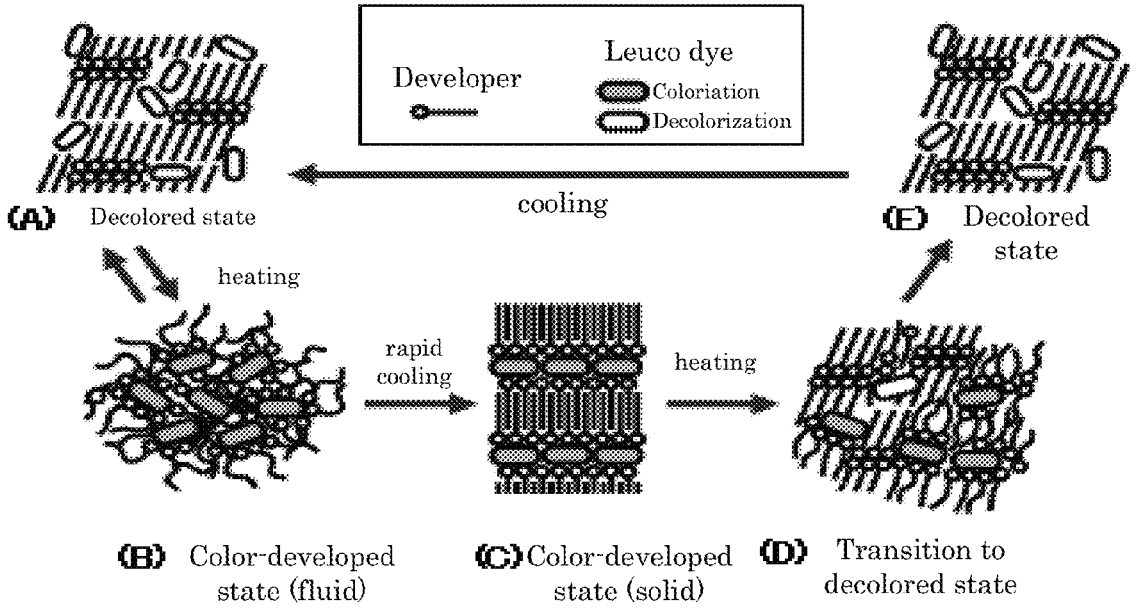
FIG. 4B is a schematic explanatory diagram indicating the mechanism by which a thermoreversible recording medium changes between color-developed state and decolored state.

FIG. 4A shows an example of the temperature-color developing density curve of the thermoreversible recording medium having a thermoreversible recording layer made of resin in which the leuco dye and the color developer are contained therein. FIG. 4B shows the mechanism by which the thermoreversible recording medium becomes transparent or colored in a reversible manner on heating.

First, the recording layer which is in a decolorized state (A) is heated, the leuco dye and the developer are melted and mixed together at a melting temperature $T_1$ and color is developed and the recording layer is in a molten color-developed state (B). When the layer is cooled rapidly, it can be cooled to room temperature while being in a molten color developing state (B) and the molten color-develop state (B) is stabilized, resulting in a stable color developed state (C). Whether or not it succeeds in obtaining this color developing state depends on the cooling rate from the molten state; when the layer is cooled gradually, discoloring occurs in the course of cooling and it returns to its original decolorized state (A) or a state of relatively lower density than the color developed state (C) by rapid cooling. Meanwhile, when the recording layer is again heated from the color developed state (C), discoloring occurs at temperature $T_2$, a temperature lower than the color developing temperature (from D to E), and when it is cooled, the recording layer returns to its original state, a decolorized state (A).

The color developed state (C), obtained by rapid cooling of the molten recording layer, is a state in which the leuco dye and the developer are mixed together in such a way that molecules may come in contact with each other for reaction. This state is often in a solid state. In this state a molten mixture (the color developed mixture) of the leuco dye and the developer is crystallized for development of color, and the color development is considered to be stabilized with this configuration. On the other hand, in the decolorized state the leuco dye and the developer are in phase separation state. In this state, molecules of at least one of the leuco dye and developer are clustered to form a domain or are crystallized; therefore, the leuco dye and the developer are considered to be separated from each other in a stabilized state by agglomeration or crystallization. In many cases, more complete discoloring occurs due to the phase separation of the leuco dye and the color developer and crystallization of the developer.

Note in FIG. 4A that both discoloring achieved by gradual cooling from a molten state and discoloring achieved by heating from a color-developed state involve changes in the structure of aggregated molecules at temperature $T_2$, thereby causing phase separation and/or crystallization of the color developer.

Also in FIG. 4A, when the recording layer is repeatedly heated to temperature $T_3$ equal to or higher than melting temperature $T_1$, erase failure may occur in which the image cannot be erased even through heating to an erase temperature. This is likely because the color developer is thermally decomposed to hardly aggregate or crystallize, which makes it difficult to be separated from the leuco dye. In order to suppress degradation of the thermoreversible recording medium due to repeated printing, the difference between melting temperature $T_1$ and temperature $T_3$ in FIG. 4A is made small when heating the thermoreversible recording medium.

—Example of Combination of Thermoreversible Recording Medium with Thermoreversible Recording Member RF-ID—

A thermoreversible recording member used in the present invention includes the reversibly displayable recording layer and an information storage unit which are disposed (integrated) to the same card or tag. Information can be checked by just looking at the card or tag without using a special instrument, thus providing excellent convenience. When the content of the information storage unit has been overwritten, the item displayed on a thermoreversible recording portion is overwritten correspondingly. In this way the thermoreversible recording medium can be used repeatedly.

The information storage unit is not particularly limited and may be appropriately selected depending on the intended purpose. Preferred examples thereof include magnetic recording layers, magnetic stripes, IC memories, optical memories, and RF-ID tags. When the information storage unit is used for process management and material management, a RF-ID tag is particularly suitable for use. Notably, the RF-ID tag is composed of an IC chip and an antenna connected to the IC chip.

The thermoreversible recording member has the reversibly displayable recording layer and information storage unit, and a preferred example of the information storage unit is a RF-ID tag.

Figure 5:
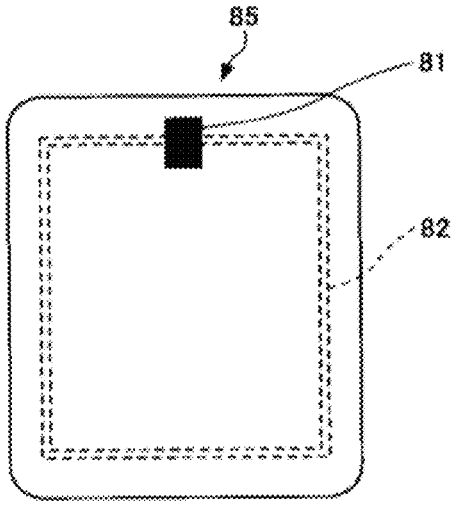
FIG. 5 is a schematic view of one exemplary RF-ID tag.

FIG. 5 shows a schematic diagram of a RF-ID tag 85. The RF-ID tag 85 is composed of an IC chip 81 and an antenna 82 connected to the IC chip 81. The IC chip 81 is divided into 4 sections: a storage unit, a power adjusting unit, a transmission unit, and a receiving unit, each of which bears a part of operation for communication. The antennas of the RF-ID tag and reader/writer exchange data by radiowave. Specifically, there are two types of communication: an electromagnetic induction system in which the antenna of RF-ID 85 receives a radiowave from the reader/writer whereby an electromotive force is generated by electromagnetic induction through resonant effect; and a radiowave system which is activated by radiated electromagnetic field. In either system, the IC chip 81 in the RF-ID tag 85 is activated by electromagnetic field from outside, information in the chip is converted into a signal which is then transmitted from the RF-ID tag 85. The information is received by the antenna of the reader/writer, recognized by a data processing device, and processed by software.

The RF-ID tag is formed into label form or card form and the RF-ID tag can be placed to the thermoreversible recording medium. The RF-ID tag can be placed on the surface of the recording layer or the back layer and it is preferably placed on the surface of the back layer. A known adhesive or sticking agent may be used for bonding together the RF-ID tag and the thermoreversible recording medium.

Moreover, the thermoreversible recording medium and the RF-ID tag may be integrated together by lamination to be formed into card form or tag form.

(Image Processing Apparatus)

An image processing apparatus of the present invention is used for the image processing method of the present invention and includes at least a laser beam emitting unit and a laser beam scanning unit; and, if necessary, further includes appropriately selected other units.

—Laser Beam Emitting Unit—

The wavelength of the laser beam emitted from the laser beam emitting unit is preferably 700 nm or longer, more preferably 720 nm or longer, further preferably 750 nm or longer. The upper limit of the wavelength of the laser beam may be appropriately selected depending on the intended purpose. The upper limit is preferably 1,500 nm, more preferably 1,300 mm, further preferably 1,200 nm.

When the laser beam having a wavelength of shorter than 700 nm is used, in the visible light region, there may be a drop in contrast upon image recording of media, and the media are colored. In the ultraviolet region shorter in wavelength, the media are likely to be degraded. Meanwhile, the light heat conversion material to be added to the thermoreversible recording medium is required to have a high decomposition temperature for ensuring durability to repeatedly performed image processing. When an organic dye is used as the light heat conversion material, it is difficult to obtain a light heat conversion material that has a high decomposition temperature and absorbs light of longer wavelengths. Thus, the wavelength of the laser beam is preferably 1,500 nm or shorter.

The laser beam emitting unit may be appropriately selected depending on the intended purpose. Examples thereof include a YAG laser, a fiber laser, a laser diode (LD) and a fiber coupling laser. Among them, a fiber coupling laser is particularly preferred, since it can easily form a light distribution of a top hat form and thus can achieve image recording with high visibility.

—Laser Beam Scanning Unit—

The laser beam scanning unit is a unit configured to scan the laser beams emitted from the laser beam emitting unit on a surface of the medium where the surface is to be irradiated with the laser beams.

The laser beam scanning unit is not particularly limited, so long as it can scan laser beams on a surface irradiated with laser beams, and may be appropriately selected depending on the intended purpose. Examples thereof include a galvanometer and a mirror attached to the galvanometer.

The above image processing apparatus is similar in basic configuration to the one that is generally called a laser marker except that the former includes at least the laser beam emitting unit and the laser beam scanning unit. This image processing apparatus further includes a oscillation unit, a power control unit and a program unit.

Figure 6:
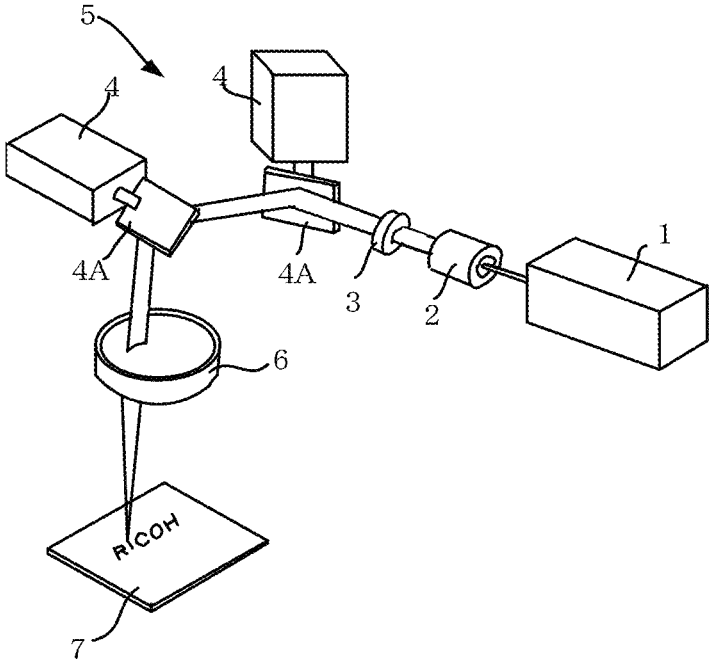
FIG. 6 is a schematic view of exemplary configuration of an image processing apparatus (laser marker device) of the present invention.

An example of the image processing apparatus of the present invention is shown in FIG. 6, with a primary focus on the laser beam emitting unit.

The oscillation unit is composed, for example, of a laser oscillator 1, a beam expander 2, and a scanning unit 5.

The laser oscillator 1 is a necessary unit for obtaining a laser beam of high intensity and high directivity. For example, a mirror is placed on both sides of the laser medium, and the laser medium is pumped (supplied with energy) to generate an induced emission by increasing the number of excited atoms to create an inverted population. A beam of light that oscillates only in an optical axis direction is selectively amplified, thereby increasing the directivity of light and emitting a laser beam from the output mirror.

The scanning unit 5 is composed of galvanometers 4 each having a mirror 4A attached to it. The two mirrors 4A that are respectively oriented in X axis direction and Y axis direction are so configured that they are rotated at a high speed to thereby cause a laser beam emitted from the laser oscillator 1 to be applied over a thermoreversible recording medium 7 for image recording or erasing.

The power control unit contains a power source for exciting a laser medium, a power source for driving galvanometers, a power source for cooling a Peltier-element and a control unit for controlling the image processing apparatus as a whole.

The program unit is a unit configured to receive conditions such as laser beam intensity and laser scanning velocity and creates and edits characters to be recorded for image forming and erasing, through touch panel input or key board input.

The laser beam emitting unit, or the image recording/erasing head, is mounted to the image processing apparatus, and the image processing apparatus is also equipped with, for example, a transfer unit for thermoreversible recording media, a control unit for the transfer unit, and a monitor (touch panel).

In the present invention, the four image processing apparatuses according to the following embodiments can be employed.

(1) An image processing apparatus containing: at least a laser beam emitting unit configured to emit laser beams; a laser beam scanning unit configured to scan the laser beams on a surface of the medium where the surface is to be irradiated with the laser beams; and an fθ lens, where the fθ lens corrects an irradiation distance in the surface of the medium irradiated with the laser beams.

Here, the irradiation distance in the surface of the medium refers to an optical path length of laser beams applied from a laser beam source to the medium via an optical lens and a scanning mirror. The angle of the scanning mirror changes depending on a position in the medium at which the laser beams are applied. As a result, the optical path length also changes depending on the position in the medium at which the laser beams are applied.

Figure 2A:
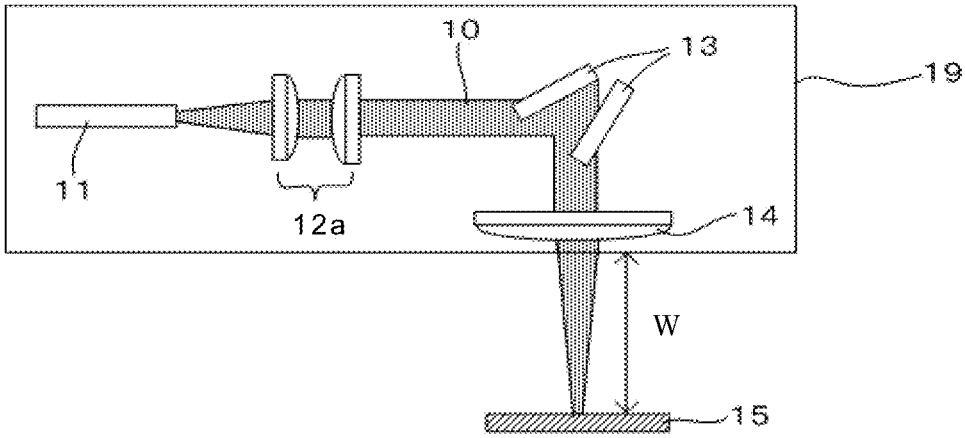
FIG. 2A is an explanatory view of exemplary configuration of a laser marker device where an fθ lens corrects an irradiation distance in a surface of a medium irradiated with laser beams.

When the theremoreversible recording medium is scanned with laser beams, the irradiation distance of laser beams is longer at the peripheral portion than at the central portion thereof. However, according to the embodiment (1) illustrated in FIG. 2A, the fθ lens is used to optically adjust the focal length at the central portion and the peripheral portion of the theremoreversible recording medium to obtain substantially the same beam diameter and light distribution shape at the central portion and the peripheral portion thereof, whereby the beam diameter can advantageously be controlled only by an optical system. In FIG. 2A, reference numeral 10 denotes laser beams, reference numeral 11 denotes a fiber coupling laser diode, reference numeral 12*a* denotes collimator lenses, reference numeral 13 denotes galvanomirrors, reference numeral 14 denotes an fθ lens, reference numeral 15 denotes a thermoreversible recording medium, reference numeral 19 denotes an optical head, and reference character W denotes an interwork distance.

(2) An image processing apparatus containing: at least a laser beam emitting unit configured to emit laser beams; a laser beam scanning unit configured to scan the laser beams on a surface of the medium where the surface is to be irradiated with the laser beams; and a lens system disposed between the laser beam emitting unit and the laser beam scanning unit and containing a lens the position of which can be moved, where the lens system corrects the irradiation distance in the medium surface irradiated with the laser beams.

Here, the irradiation distance in the surface of the medium has the same meaning as described in the embodiment (1).

When the theremoreversible recording medium is scanned with laser beams, the irradiation distance of laser beams is longer at the peripheral portion than at the central portion. However, according to the embodiment (2) illustrated in FIG. 2B, the position of the lens is adjusted to adjust the focal length at the central portion and the peripheral portion of the theremoreversible recording medium to obtain substantially the same beam diameter and light distribution shape at the central portion and the peripheral portion thereof. This embodiment realizes a simple optical design without using an fθ lens, and condenses beams before reaching a scanning mirror to elongate the focal length and deepen the focal depth, whereby an inexpensive apparatus with a smaller scanning mirror can advantageously be obtained.

Figure 2B:
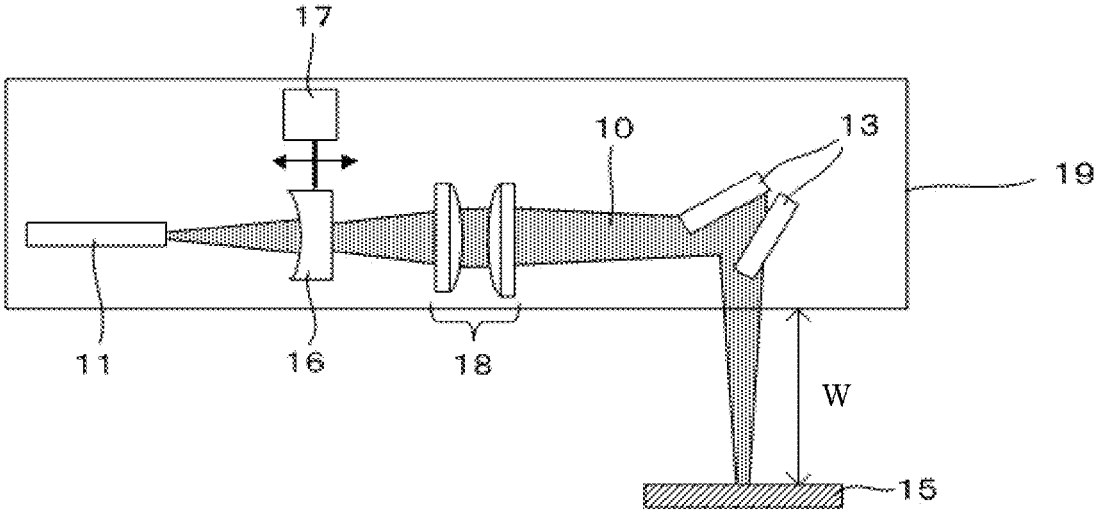
FIG. 2B is an explanatory view of exemplary configuration of a laser marker device where a lens system containing a lens the position of which can be moved corrects an irradiation distance in a surface of a medium irradiated with laser beams.

In FIG. 2B, reference numeral 10 denotes laser beams, reference numeral 11 denotes a fiber coupling laser diode, reference numeral 13 denotes galvanomirrors, reference numeral 15 denotes a thermoreversible recording medium, reference numeral 16 denotes a focal position-adjusting lens, reference numeral 17 denotes a lens position-controlling mechanism, reference numeral 18 denotes a light condensing lens system, reference numeral 19 denotes an optical head, and reference character W denotes an interwork distance.

Notably, the shape of the focal position-adjusting lens 16 is not particularly limited and may be a shape one surface of which is concave or a shape both surfaces of which are concave.

The light condensing lens system 18 is composed of two fixed lenses and one movable lens, and adjusts the position of the movable lens depending on the angle of the galvanoscanner, so that beams can be condensed at the same interwork distance without depending on the angle of the galvanoscanner.

(3) An image processing apparatus containing: at least a laser beam emitting unit configured to emit laser beams; a laser beam scanning unit configured to scan the laser beams on a surface of the medium where the surface is to be irradiated with the laser beams; and a lens system disposed between the laser beam emitting unit and the laser beam scanning unit and containing a lens the position of which can be moved, where the lens system corrects at least one of the position of the medium and the irradiation distance in the surface of the medium irradiated with the laser beams.

Here, the irradiation distance in the surface of the medium has the same meaning as described in the embodiment (1), and the position of the medium refers to the distance between the medium and the laser beam emitting surface of the optical head of the image processing apparatus; i.e., interwork distance.

When the theremoreversible recording medium is scanned with laser beams, the irradiation distance of laser beams is longer at the peripheral portion than at the central portion. Also, the interwork distance changes depending on the position of the theremoreversible recording medium. However, according to the embodiment (3) illustrated in FIG. 2C, the position of the lens is adjusted to adjust the focal length at the central portion and the peripheral portion of the theremoreversible recording medium at each interwork distance to obtain substantially the same beam diameter and light distribution shape at the central portion and the peripheral portion of the theremoreversible recording medium regardless of the position of the theremoreversible recording medium. This embodiment realizes a simple optical design without using an fθ lens, and condenses beams before reaching a scanning mirror to elongate the focal length and deepen the focal depth, whereby an inexpensive apparatus with a smaller scanning mirror can advantageously be obtained. Here, the adjustable range is limited to a range where the adjustment can be performed at each interwork distance. Thus, combining with adjusting the irradiation energy can broaden the adjustable range of the interwork distance.

Figure 2C:
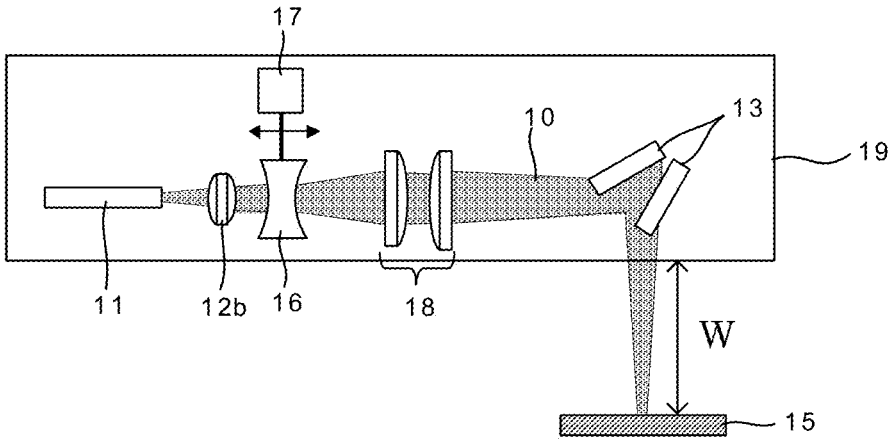
FIG. 2C is an explanatory view of exemplary configuration of a laser marker device where a lens system containing a lens the position of which can be moved corrects at least one of a position of a medium and an irradiation distance in a surface of a medium irradiated with laser beams.

In FIG. 2C, reference numeral 10 denotes laser beams, reference numeral 11 denotes a fiber coupling laser diode, reference numeral 12*b* denotes a collimator lens, reference numeral 13 denotes galvanomirrors, reference numeral 15 denotes a thermoreversible recording medium, reference numeral 16 denotes a focal position-adjusting lens, reference numeral 17 denotes a lens position-controlling mechanism, reference numeral 18 denotes a light condensing lens system, reference numeral 19 denotes an optical head, and reference character W denotes an interwork distance.

In FIG. 2C, when the collimator lens 12*b* is not provided, the focal position-adjusting lens 16 must be large to unable to move at high speed, failing to achieve high-speed printing.

Notably, the shape of the focal position-adjusting lens 16 is not particularly limited and may be a shape one surface of which is concave or a shape both surfaces of which are concave.

The light condensing lens system 18 is composed of two fixed lenses and one movable lens, and adjusts the position of the movable lens depending on the angle of the galvanoscanner, so that beams can be condensed at the same interwork distance without depending on the angle of the galvanoscanner and also the distance of the focal position due to displacement in interwork distance can be corrected.

(4) An image processing apparatus containing: at least a laser beam emitting unit configured to emit laser beams; and a laser beam scanning unit configured to scan the laser beams on a surface of the medium where the surface is to be irradiated with the laser beams, where the irradiation energy is adjusted to correct at least one of the position of the medium and the irradiation distance in the surface of the medium irradiated with the laser beams.

Here, the irradiation distance in the surface of the medium has the same meaning as described in the embodiment (1), and the position of the medium has the same meaning as described in the embodiment (3).

When the thermoreversible recording medium is scanned with laser beams, the irradiation distance of laser beams is longer at the peripheral portion than at the central portion; i.e., the beam diameter is not the same at the central portion and the peripheral portion of the thermoreversible recording medium. However, according to the embodiment (4) illustrated in FIG. 2D, the irradiation energy can be adjusted for correction and thus an optical system and a control system are both inexpensive. Here, the beam diameter becomes large at the peripheral portion of the medium, so that a correctable region (printable range, interwork distance) becomes narrowed.

Figure 2D:
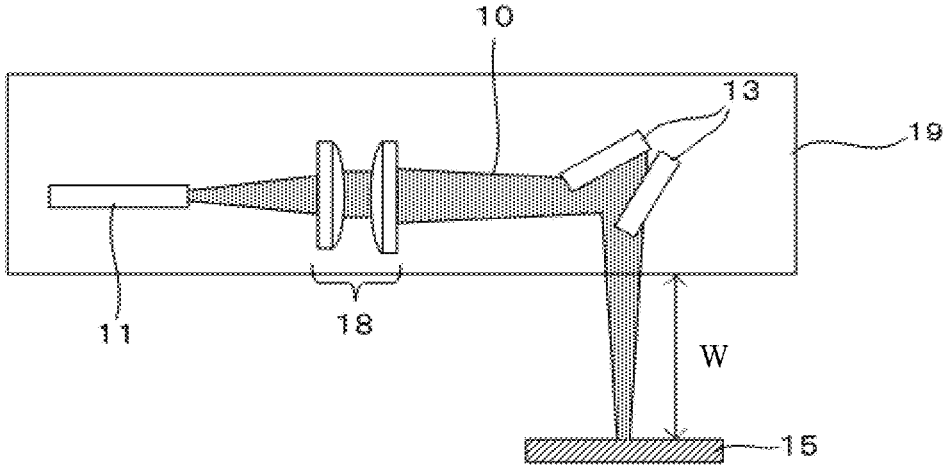
FIG. 2D is an explanatory view of exemplary configuration of a laser marker device where the irradiation energy is adjusted to correct at least one of a position of a medium and an irradiation distance in a surface of a medium irradiated with laser beams.

In FIG. 2D, reference numeral 10 denotes laser beams, reference numeral 11 denotes a fiber coupling laser diode, reference numeral 13 denotes galvanomirrors, reference numeral 15 denotes a thermoreversible recording medium, reference numeral 18 denotes a light condensing lens system, reference numeral 19 denotes an optical head, and reference character W denotes an interwork distance.

The light condensing lens system 18 uses two fixed lenses.

The image erasing method and image erasing apparatus of the present invention can repeatedly erase an image on a thermoreversible recording medium in a non-contact manner, such as a label attached to a cardboard or plastic container. Thus, they can particularly suitably used in distribution/delivery systems. In this case, while the cardboard or plastic container is being moved on a belt conveyer, an image can be formed or erased on a label. It is not necessary to stop the line, resulting in shortening the time required for shipping.

The label can be recycled as is for image erasure and formation without being peeled off from the cardboard or plastic container.

EXAMPLES

The present invention will next be described by way of Examples, which should not be construed as limiting the present invention thereto.

Production Example 1

<Production of Thermoreversible Recording Medium>

A thermoreversible recording medium reversibly changing in color by heat was produced in the following manner.

—Support—

A milky polyester film having a thickness of 125 μm (TETRON (registered trademark) film U2L98W, product of Teijin Dupont Co.) was used as a support.

—Formation of First Oxygen Barrier Layer—

A urethane adhesive (TM-567, product of Toyo-Morton, Ltd.) (5 parts by mass), an isocyanate (CAT-RT-37, product of Toyo-Morton, Ltd.) (0.5 parts by mass) and ethyl acetate (5 parts by mass) are mixed together, followed by thoroughly stirring, to thereby prepare an oxygen barrier layer-coating liquid.

Next, the prepared oxygen barrier layer-coating liquid was applied with a wire bar onto a silica vapor deposition PET film (TECHBARRIER HX, oxygen permeability: 0.5 $mL/m^2/day/MPa$, product of Mitsubishi Plastics Inc.), followed by heating and drying at 80° C. for 1 min. This silica vapor deposition PET film having the oxygen barrier layer was attached to the above support, followed by heating at 50° C. for 24 hours, to thereby form a first oxygen barrier layer having a thickness of 12 μm.

—Formation of First Thermoreversible Recording Layer—

A reversible color developer having the following Structural Formula (1) (5 parts by mass), a color erasure accelerator having the following Structural Formula (2) (0.5 parts by mass), another color erasure accelerator having the following Structural Formula (3) (0.5 parts by mass), a 50% by mass acrylpolyol solution (hydroxyl value: 200 mgKOH/g) (10 parts by mass) and methyl ethyl ketone (80 parts by mass) were milled and dispersed with a ball mill until the average particle diameter of these materials was about 1 μm.

Structural Formula (1)

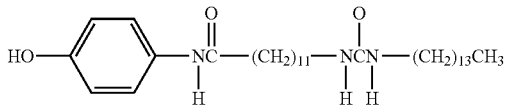

Structural Formula (2)

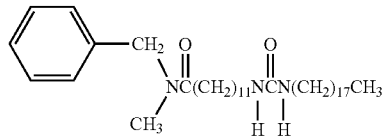

Structural Formula (3)

$C_{17}H_{35}CONHC_{18}H_{35}$

Next, 2-anilino-3-methyl-6-dibutylaminofluoran serving as a leuco dye (1 part by mass) and an isocyanate (CORONATE HL, product of NIPPON POLYURETHANE INDUSTRIES CO., LTD.) (5 parts by mass) were added to the above prepared dispersion liquid in which the reversible color developer had been milled and dispersed, followed by thoroughly stirring, to thereby prepare a thermoreversible recording layer-coating liquid.

The prepared thermoreversible recording layer-coating liquid was applied on the first oxygen barrier layer with a wire bar, followed by drying at 100° C. for 2 min and then by curing at 60° C. for 24 hours, to thereby form a first thermoreversible recording layer having a thickness of 6.0 μm.

—Formation of Light Heat Converting Layer—

A 1% by mass solution of a phthalocyanine light heat converting material (IR915, absorption peak wavelength: 956 nm, product of NIPPON SHOKUBAI CO., LTD.) (4 parts by mass), a 50% by mass solution of acrylpolyol (hydroxyl value: 200 mgKOH/g) (10 parts by mass), methyl ethyl ketone (20 parts by mass) and an isocyanate serving as a crosslinking agent (trade name: CORONATE HL, product of NIPPON POLYURETHANE INDUSTRIES CO., LTD.) (5 parts by mass) were mixed together with stirring to thereby prepare a light heat converting layer-coating liquid. The prepared light heat converting layer-coating liquid was applied on the first thermoreversible recording layer with a wire bar, followed by drying at 90° C. for 1 min and then by curing at 60° C. for 24 hours, to thereby form a light heat converting layer having a thickness of 3 μm.

—Formation of Second Thermoreversible Recording Layer—

The same thermoreversible recording layer composition as used for forming the first thermoreversible recording layer was applied on the light heat converting layer with a wire bar, followed by drying at 100° C. for 2 min and then by curing at 60° C. for 24 hours, to thereby form a second thermoreversible recording layer having a thickness of 6.0 μm.

—Formation of UV Ray Absorption Layer—

A 40% by mass solution of a UV ray absorbing polymer (UV-G300, product of NIPPON SHOKUBAI CO., LTD.) (10 parts by mass) an isocyanate (CORONATE HL, product of NIPPON POLYURETHANE INDUSTRIES CO., LTD.) (1.5 parts by mass) and methyl ethyl ketone (12 parts by mass) were mixed together with stirring to prepare a UV ray absorption layer-coating liquid.

Next, the prepared UV ray absorption layer-coating liquid was applied on the second thermoreversible recording layer with a wire bar, followed by heating and drying at 90° C. for 1 min and then by heating at 60° C. for 24 hours, to thereby form a UV ray absorption layer having a thickness of 1 μm.

—Formation of Second Oxygen Barrier Layer—

The same silica vapor deposition PET film having the oxygen barrier layer as used as the first oxygen barrier layer was attached to the UV ray absorption layer, followed by heating at 50° C. for 24 hours, to thereby form a second oxygen barrier layer having a thickness of 12 μm.

—Formation of Back Layer—

Pentaerythritol hexaacrylate (KAYARAD DPHA, product of Nippon Kayaku Co., Ltd.) (7.5 parts by mass), 2.5 parts by mass of urethaneacrylate oligomer (Art Resin UN-3320HA, product of Negami Chemical Industrial Co., Ltd.), 2.5 parts by mass of needle-shaped electroconductive titanium oxide (FT-3000, product of Ishihara Sangyo Kaisha, Ltd., long axis=5.15 μm, short axis=0.27 μm, composition: titanium oxide coated with antimony-doped tin oxide), 0.5 parts by mass of a photopolymerization initiator (Irgacure 184, product of Nippon Ciba-Geigy K.K.) and 13 parts by mass of isopropyl alcohol were mixed together with thoroughly stirring in a ball mill to prepare a back layer-coating liquid.

Next, the prepared back layer-coating liquid was applied with a wire bar onto a surface of the support where the first thermoreversible recording layer and other layers had not been formed, followed by heating and drying at 90° C. for 1 min and then by crosslinking using a UV lamp of 80 W/cm, to thereby form a back layer having a thickness of 4 μm. In this way a thermoreversible recording medium of Production Example 1 was produced.

Production Example 2

—Production of Thermoreversible Recording Medium—

The procedure of Production Example 1 was repeated, except that lanthanum boride (product of Sumitomo Metal Mining Co., Ltd.) serving as a light heat converting material was added to the thermoreversible recording layer-coating liquid so that the sensitivity of lanthanum boride was the same as that of the light heat converting material in Production Example 1, that the thermoreversible recording layer-coating liquid containing lanthanum boride was used to form a first thermoreversible recording layer having a thickness of 12 μm; and none of the second thermoreversible recording layer, the light heat converting layer and the second barrier layer were formed, to thereby produce a thermoreversible recording medium of Production Example 2.

Example 1

Image recording was performed on the thermoreversible recording medium of Production Example 2 using a LD marker device where fiber coupling LD (laser diode) BMU25-975-01-R (product of Oclaro Co.) (central wavelength: 976 nm) was caused to emit laser beams, which were enlarged using two collimator lenses to be parallel beams, and galvanoscanner 6230H (product of Cambridge Co.) was used to scan the beams, which were condensed with an fθ lens on the thermoreversible recording medium.

In the LD marker device, the beam diameter is smallest when the interwork distance W (see FIG. 2A) between the thermoreversible recording medium and the laser beam emitting surface of the optical head equipped with the fθ lens from which laser beams are emitted is 175 mm (focal position).

At the interwork distance W being 175 mm (focal position), the laser beam irradiation power was adjusted so that the laser irradiation energy became 11.0 mJ/mm$^2$ with the linear velocity being 3,000 mm/s, to thereby print line images and bar-code images at the central and peripheral portions of the thermoreversible recording medium.

At the interwork distance W being 167 mm or 183 mm, the laser beam irradiation power was adjusted so as to correct the laser irradiation energy to 13.0 mJ/mm$^2$ with the linear velocity being 3,000 mm/s, to thereby print line images and bar-code images at the central and peripheral portions of the thermoreversible recording medium.

The obtained line images and bar-code images were evaluated for line image density, line image width and grade of bar-code images in the following manner. The results are shown in Tables 1-1 to 1-2.

Here, the interwork distance refers to a distance between the thermoreversible recording medium and the laser beam emitting surface of the optical head of the LD marker device, and the interwork distance was measured with a laser displacement meter (product of Panasonic Electric Works Co., Ltd.).

The central portion of the thermoreversible recording medium refers to a laser-irradiated region in the vicinity of the optical axis of the LD marker device (fθ lens). The peripheral portion of the thermoreversible recording medium refers to a laser-irradiated region distant from the optical axis. The LD marker device of this Example is configured to be able to print a region of 120 mm×120 mm around the optical axis. As the irradiation position (X, Y), the central portion can be set from the position of the optical axis (0 mm, 0 mm) up to the position (±60 mm, ±60 mm). In this Example, the center of each of the bar-code image and the line image was set to the position (0 mm, 0 mm) at the central portion and to the position (50 mm, 50 mm) at the peripheral portion.

<Line Image Density>

The density of the line image was measured as follows. Specifically, a gray scale (product of Kodak Co.) was scanned with a scanner (Canoscan 4400, product of Canon Co.) in a gray scale mode and stored as a bit map file. Then, correlation data were previously obtained between digital gradations derived from the bit map file and densities measured using a reflection densitometer (Type939, product of X-rite). Then, the line image formed was scanned with the above scanner in a gray scale mode, and the digital gradation obtained from the bit map file was converted to a density, which was defined as a line image density.

<Line Image Width>

The width of the line image was measured similar to the measurement of the line image density. Specifically, the line image was scanned with a scanner in a gray scale mode and stored as a bit map file. Then, the number of pixels of the line width corresponding to the half value of the density was measured and multiplied by the size of one pixel scanned with the scanner.

<Evaluation of Grade of Bar-Code Image>

The grade of the bar-code image was evaluated as follows. The bar-code image was measured with bar-code verifier TruCheck TC401RL (product of Web scan Co.) and the obtained measurement was graded by the method according to ISO-15416 in terms of bar-code quality as 5 grades: A, B, C, D and F where grade A is the best, and B, C, D and F in the order of degrading. Grades A to C involve no problem in readability by a bar-code reader. Grade D involves a case where a bar-code sometimes cannot be read by a bar-code reader having poor reading ability. Grade F involves a case where a bar-code cannot be read frequently. Thus, to ensure stable readability by a bar-code reader, a bar-code image has to be graded as grade C, B or A.

Example 2

Image recording was preformed in the same manner as in Example 1. Specifically, at the interwork distance W being 175 mm (focal position), the laser beam irradiation power was adjusted so that the laser irradiation energy became 11.0 mJ/mm$^2$ with the linear velocity being 3,000 mm/s, to thereby print line images and bar-code images at the central portion and the peripheral portion of the thermoreversible recording medium. At the interwork distance W being 167 mm or 183 mm, the scanning velocity was changed to a linear velocity of 2,538 mm/s to correct the laser irradiation energy to 13.0 mJ/mm$^2$ with the laser beam irradiation power being set to the same as in the case where the interwork distance W was 175 mm, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-1 and 1-2.

Example 3

The procedure of Example 1 was repeated, except that the thermoreversible recording medium of Production Example 2 was changed to the thermoreversible recording medium of Production Example 1, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-1 and 1-2.

Comparative Example 1

The procedure of Example 1 was repeated, except that the irradiation energy was not corrected, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-1 and 1-2.

Example 4

Image recording was performed on the thermoreversible recording medium of Production Example 2 using a LD marker device where fiber coupling LD (laser diode) BMU25-975-01-R (product of Oclaro Co.) (central wavelength: 976 nm) was caused to emit laser beams, which were condensed with a condensing lens system (which is composed of two fixed lenses and one movable lens where the position of the movable lens is adjusted depending on the angle of the galvanoscanner 6230H (product of Cambridge Co.) to condense beams at the same interwork distance without depending on the angle of the galvanoscanner) and the galvanoscanner 6230H (product of Cambridge Co.) was used to scan the beams, which were condensed on the thermoreversible recording medium. The beam diameter is smallest when the interwork distance W (see FIG. 2B) between the thermoreversible recording medium and the laser beam emitting surface of the optical head of the LD marker device is 120 mm (focal position).

At the interwork distance W being 120 mm (focal position), the laser irradiation energy was adjusted to 11.0 mJ/mm$^2$ and the linear velocity was adjusted to 3,000 mm/s, to thereby print line images and bar-code images at the central and peripheral portions of the thermoreversible recording medium. The LD marker device of this Example is configured to be able to print a region of 120 mm×120 mm around the optical axis. As the irradiation position (X, Y), the central portion can be set from the position of the optical axis (0 mm, 0 mm) up to the position (±60 mm, ±60 mm). In this Example, the center of each of the bar-code image and the line image was set to the position (0 mm, 0 mm) at the central portion and to the position (50 mm, 50 mm) at the peripheral portion.

At the interwork distance W being 110 mm or 130 mm, the laser beam irradiation power was adjusted so as to correct the laser irradiation energy to 13.0 mJ/mm$^2$ with the linear velocity being 3,000 mm/s, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-1 and 1-2.

Example 5

Image recording was preformed in the same manner as in Example 4. Specifically, at the interwork distance W being 120 mm (focal position), the laser beam irradiation power was adjusted so that the laser irradiation energy was 11.0 mJ/mm$^2$ with the linear velocity being 3,000 mm/s, to thereby print line images and bar-code images at the central and peripheral portions of the thermoreversible recording medium.

At the interwork distance W being 110 mm or 130 mm, the scanning velocity was changed to a linear velocity of 2,538 mm/s to correct the laser irradiation energy to 13.0 mJ/mm$^2$ with the laser beam irradiation power being set to the same as in the case where the interwork distance W was 120 mm, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-1 and 1-2.

Example 6

The procedure of Example 4 was repeated, except that the thermoreversible recording medium of Production Example 2 was changed to the thermoreversible recording medium of Production Example 1, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-1 and 1-2.

Example 7

Image recording was preformed in the same manner as in Example 4. Specifically, at the interwork distance W being 120 mm (focal position), the laser beam irradiation power was adjusted so that the laser irradiation energy became 11.0 mJ/mm$^2$ with the linear velocity being 3,000 mm/s, to thereby print line images and bar-code images at the central and peripheral portions of the thermoreversible recording medium.

At the interwork distance W being 102 mm, the position of the movable lens was optically corrected to be focal distance 110 mm and the laser beam irradiation power was adjusted so as to correct the laser irradiation energy to 12.9 mJ/mm$^2$ with the linear velocity being 3,000 mm/s, to thereby print line images and bar-code images at the central and peripheral portions of the thermoreversible recording medium.

At the interwork distance W being 138 mm, the position of the movable lens was optically corrected to be focal position 130 mm and the laser beam irradiation power was adjusted so as to correct the laser irradiation energy to 13.1 mJ/mm$^2$ with the linear velocity being 3,000 mm/s to thereby print line images and bar-code images at the central and peripheral portions of the thermoreversible recording medium.

Comparative Example 2

The procedure of Example 4 was repeated, except that the irradiation energy was not corrected, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-1 and 1-2.

Example 8

Image recording was performed on the thermoreversible recording medium of Production Example 2 using a LD marker device where fiber coupling LD (laser diode) BMU25-975-01-R (product of Oclaro Co.) (central wavelength: 976 nm) was caused to emit laser beams, which were condensed with a condensing lens system composed of two fixed lenses, and the galvanoscanner 6230H (product of Cambridge Co.) was used to scan the beams, which were condensed on the thermoreversible recording medium. The beam diameter is smallest when the interwork distance W (see FIG. 2D) between the thermoreversible recording medium and the laser beam emitting surface of the optical head of the LD marker device is 120 mm (focal position).

At the interwork distance W being 120 mm (focal position), the laser irradiation energy was adjusted to 11.0 mJ/mm$^2$ and the liner velocity was adjusted to 3,000 mm/s, to thereby print line images and bar-code images at the central and peripheral portions of the thermoreversible recording medium. The LD marker device of this Example is configured to be able to print a region of 90 mm×90 mm around the optical axis. As the irradiation position (X, Y), the central portion can be set from the position of the optical axis (0 mm, 0 mm) up to the position (±45 mm, ±45 mm). In this Example, the center of each of the bar-code image and the line image was set to the position (0 mm, 0 mm) at the central portion and to the position (35 mm, 35 mm) at the peripheral portion.

At the interwork distance W being 113 mm or 127 mm, the laser beam irradiation power was adjusted so as to correct the laser irradiation energy to 13.5 mJ/mm$^2$ with the linear velocity being 3,000 mm/s, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-3 and 1-4.

Example 9

Image recording was preformed in the same manner as in Example 8. Specifically, at the interwork distance W being 120 mm (focal position), the laser beam irradiation power was adjusted so that the laser irradiation energy was 11.0 mJ/mm$^2$ with the linear velocity being 3,000 mm/s, to thereby print line images and bar-code images at the central and peripheral portions of the thermoreversible recording medium.

At the interwork distance W being 113 mm or 127 mm, the scanning velocity was changed to a linear velocity of 2,444 mm/s to correct the laser irradiation energy to 13.5 mJ/mm$^2$ with the laser beam irradiation power being set to the same in the case where the interwork distance W was 120 mm, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-3 and 1-4.

Example 10

The procedure of Example 8 was repeated, except that the thermoreversible recording medium of Production Example 2 was changed to the thermoreversible recording medium of Production Example 1, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-3 and 1-4.

Comparative Example 3

The procedure of Example 8 was repeated, except that the irradiation energy was not corrected, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-3 and 1-4.

Example 11

Image recording was performed on the thermoreversible recording medium of Production Example 2 using a laser marker device where a YAG laser (solid laser, central wavelength: 1,060 nm) was caused to emit laser beams, which were enlarged using two collimater lenses to be parallel beams, and galvanoscanner 6230H (product of Cambridge Co.) was used to scan the beams, which were condensed with an fθ lens on the thermoreversible recording medium.

In the LD marker device, the beam diameter is smallest when the interwork distance W (see FIG. 2A) between the thermoreversible recording medium and the laser beam emitting surface of the optical head of equipped with the fθ lens from which laser beams are emitted is 170 mm (focal position).

At the interwork distance W being 170 mm (focal position), the laser beam irradiation power was adjusted so that the laser irradiation energy became 12.0 mJ/mm$^2$ with the linear velocity being 3,000 mm/s, to thereby print line images and bar-code images at the central and peripheral portions of the thermoreversible recording medium. The LD marker device of this Example is configured to be able to print a region of 120 mm×120 mm around the optical axis. As the irradiation position (X, Y), the central portion can be set from the position of the optical axis (0 mm, 0 mm) up to the position (±60 mm, ±60 mm). In this Example, the center of each of the bar-code image and the line image was set to the position (0 mm, 0 mm) at the central portion and to the position (50 mm, 50 mm) at the peripheral portion.

At the interwork distance W being 162 mm or 178 mm, the laser beam irradiation power was adjusted so as to correct the laser irradiation energy to 14.8 mJ/mm$^2$ with the linear velocity being 3,000 mm/s, to thereby print line images and bar-code images at the central and peripheral portions of the thermoreversible recording medium.

The obtained line images and bar-code images were evaluated for line image density, line image width and grade of bar-code images in the same manner as in Example 1. The results are shown in Tables 1-3 and 1-4.

TABLE 1-1

| | | Central portion | | | |
|---|---|---|---|---|---|
| | Interwork | Line image | | | Bar-code |
| | distance | Density | Line width | Position | grade |
| Ex. 1 | 175 mm | 1.25 | 0.25 mm | (0 mm, 0 mm) | C |
| | 167 mm | 1.24 | 0.25 mm | | C |
| | 183 mm | 1.26 | 0.25 mm | | C |
| Ex. 2 | 175 mm | 1.26 | 0.25 mm | | C |
| | 167 mm | 1.26 | 0.25 mm | | C |
| | 183 mm | 1.24 | 0.25 mm | | C |
| Ex. 3 | 175 mm | 1.24 | 0.25 mm | | C |
| | 167 mm | 1.22 | 0.25 mm | | C |
| | 183 mm | 1.23 | 0.25 mm | | C |
| Comp. | 175 mm | 1.25 | 0.25 mm | (0 mm, 0 mm) | C |
| Ex. 1 | 167 mm | 0.91 | 0.19 mm | | D |
| | 183 mm | 0.88 | 0.18 mm | | D |
| Ex. 4 | 120 mm | 1.24 | 0.25 mm | (0 mm, 0 mm) | C |
| | 110 mm | 1.24 | 0.25 mm | | C |
| | 130 mm | 1.22 | 0.25 mm | | C |
| Ex. 5 | 120 mm | 1.25 | 0.25 mm | | C |
| | 110 mm | 1.24 | 0.25 mm | | C |
| | 130 mm | 1.23 | 0.25 mm | | C |
| Ex. 6 | 120 mm | 1.23 | 0.25 mm | | C |
| | 110 mm | 1.21 | 0.25 mm | | C |
| | 130 mm | 1.21 | 0.25 mm | | C |
| Ex. 7 | 120 mm | 1.23 | 0.25 mm | | C |
| | 102 mm | 1.21 | 0.25 mm | | C |
| | 138 mm | 1.20 | 0.25 mm | | C |
| Comp. | 120 mm | 1.22 | 0.25 mm | (0 mm, 0 mm) | C |
| Ex. 2 | 110 mm | 0.94 | 0.21 mm | | D |
| | 130 mm | 0.92 | 0.20 mm | | D |

TABLE 1-2

| | | Peripheral portion | | | |
|---|---|---|---|---|---|
| | Interwork | Line image | | | Bar-code |
| | distance | Density | Line width | Position | grade |
| Ex. 1 | 175 mm | 1.23 | 0.25 mm | (50 mm, 50 mm) | C |
| | 167 mm | 1.22 | 0.25 mm | | C |
| | 183 mm | 1.21 | 0.25 mm | | C |
| Ex. 2 | 175 mm | 1.24 | 0.25 mm | | C |
| | 167 mm | 1.23 | 0.25 mm | | C |
| | 183 mm | 1.22 | 0.25 mm | | C |

TABLE 1-2-continued

| | | Peripheral portion | | | |
|---|---|---|---|---|---|
| | Interwork | Line image | | | Bar-code |
| | distance | Density | Line width | Position | grade |
| Ex. 3 | 175 mm | 1.23 | 0.25 mm | | C |
| | 167 mm | 1.21 | 0.25 mm | | C |
| | 183 mm | 1.21 | 0.25 mm | | C |
| Comp. | 175 mm | 1.21 | 0.25 mm | (50 mm, 50 mm) | C |
| Ex. 1 | 167 mm | 0.89 | 0.19 mm | | D |
| | 183 mm | 0.85 | 0.18 mm | | D |
| Ex. 4 | 120 mm | 1.24 | 0.25 mm | (50 mm, 50 mm) | C |
| | 110 mm | 1.23 | 0.25 mm | | C |
| | 130 mm | 1.22 | 0.25 mm | | C |
| Ex. 5 | 120 mm | 1.24 | 0.25 mm | | C |
| | 110 mm | 1.24 | 0.25 mm | | C |
| | 130 mm | 1.23 | 0.25 mm | | C |
| Ex. 6 | 120 mm | 1.25 | 0.25 mm | | C |
| | 110 mm | 1.24 | 0.25 mm | | C |
| | 130 mm | 1.24 | 0.25 mm | | C |
| Ex. 7 | 120 mm | 1.25 | 0.25 mm | | C |
| | 102 mm | 1.23 | 0.25 mm | | C |
| | 138 mm | 1.22 | 0.25 mm | | C |
| Comp. | 120 mm | 1.23 | 0.25 mm | (50 mm, 50 mm) | C |
| Ex. 2 | 110 mm | 0.91 | 0.20 mm | | D |
| | 130 mm | 0.89 | 0.20 mm | | D |

TABLE 1-3

| | | Central portion | | | |
|---|---|---|---|---|---|
| | Interwork | Line image | | | Bar-code |
| | distance | Density | Line width | Position | grade |
| Ex. 8 | 120 mm | 1.24 | 0.25 mm | (0 mm, 0 mm) | C |
| | 113 mm | 1.23 | 0.25 mm | | C |
| | 127 mm | 1.22 | 0.25 mm | | C |
| Ex. 9 | 120 mm | 1.26 | 0.25 mm | | C |
| | 113 mm | 1.24 | 0.25 mm | | C |
| | 127 mm | 1.24 | 0.25 mm | | C |
| Ex. 10 | 120 mm | 1.24 | 0.25 mm | | C |
| | 113 mm | 1.23 | 0.25 mm | | C |
| | 127 mm | 1.22 | 0.25 mm | | C |
| Comp. | 120 mm | 1.26 | 0.25 mm | (0 mm, 0 mm) | C |
| Ex. 3 | 113 mm | 0.95 | 0.21 mm | | D |
| | 127 mm | 0.91 | 0.20 mm | | D |
| Ex. 11 | 170 mm | 1.25 | 0.25 mm | (0 mm, 0 mm) | C |
| | 162 mm | 1.20 | 0.28 mm | | C |
| | 178 mm | 1.19 | 0.29 mm | | C |

TABLE 1-4

| | | Peripheral portion | | | |
|---|---|---|---|---|---|
| | Interwork | Line image | | | Bar-code |
| | dist ance | Density | Line width | Position | grade |
| Ex. 8 | 120 mm | 1.21 | 0.25 mm | (35 mm, 35 mm) | C |
| | 113 mm | 1.19 | 0.25 mm | | C |
| | 127 mm | 1.17 | 0.25 mm | | C |
| Ex. 9 | 120 mm | 1.22 | 0.25 mm | | C |
| | 113 mm | 1.20 | 0.25 mm | | C |
| | 127 mm | 1.20 | 0.25 mm | | C |
| Ex. 10 | 120 mm | 1.22 | 0.25 mm | | C |
| | 113 mm | 1.18 | 0.25 mm | | C |
| | 127 mm | 1.17 | 0.25 mm | | C |
| Comp. | 120 mm | 0.96 | 0.20 mm | (35 mm, 35 mm) | F |
| Ex. 3 | 113 mm | 0.69 | 0.15 mm | | F |
| | 127 mm | 0.62 | 0.14 mm | | F |
| Ex. 11 | 170 mm | 1.24 | 0.25 mm | (50 mm, 50 mm) | C |
| | 162 mm | 1.12 | 0.28 mm | | C |
| | 178 mm | 1.10 | 0.29 mm | | D |

The embodiments of the present invention are as follows.

<1> An image processing method including:

measuring a distance between a medium where an image is to be recorded and an image processing apparatus which stores a relation between irradiation energy and distance previously measured;

calculating an irradiation energy from the distance measured in the measuring based on the relation stored in the image processing apparatus; and irradiating and heating the medium with laser beams having the irradiation energy obtained in the calculating to record an image in the medium.

<2> The image processing method according to <1>, wherein the image processing apparatus includes: a laser beam emitting unit configured to emit laser beams; a laser beam scanning unit configured to scan the laser beams on a surface of the medium where the surface is to be irradiated with the laser beams; and an fθ lens, where the fθ lens corrects an irradiation distance in the surface of the medium.

<3> The image processing method according to <1>, wherein the image processing apparatus includes: a laser beam emitting unit configured to emit laser beams; a laser beam scanning unit configured to scan the laser beams on a surface of the medium where the surface is to be irradiated with the laser beams; and a lens system disposed between the laser beam emitting unit and the laser beam scanning unit and capable of correcting a focal length, where the lens system corrects at least one of a position of the medium and an irradiation distance in the surface of the medium.

<4> The image processing method according to <1>, wherein the image processing apparatus includes: a laser beam emitting unit configured to emit laser beams; and a laser beam scanning unit configured to scan the laser beams on a surface of the medium where the surface is to be irradiated with the laser beams, where the image processing apparatus adjusts an irradiation energy to correct at least one of a position of the medium and an irradiation distance in the surface of the medium.

<5> The image processing method according to any one of <1> to <4>, wherein the irradiation energy of the laser beams is adjusted by adjusting an irradiation power of the laser beams.

<6> The image processing method according to any one of <1> to <5>, wherein the irradiation energy of the laser beams is adjusted by adjusting a scanning velocity of the laser beams.

<7> The image processing method according to any one of <1> to <6>, wherein the laser beam emitting unit includes a laser beam source and the laser beam source is a fiber coupling laser.

<8> The image processing method according to any one of <1> to <7>, wherein the laser beams with which the medium is irradiated have a wavelength of 700 nm to 1,600 nm.

<9> The image processing method according to any one of <1> to <8>, wherein the medium is a thermoreversible recording medium including: a support; a first thermoreversible recording layer; a light heat converting layer containing a light heat converting material which absorbs light having a specific wavelength and converts the light to heat; and a second thermoreversible recording layer, where the first thermoreversible recording layer, the light heat converting layer, and the second thermoreversible recording layer are provided on the support in this order, and wherein each of the first thermoreversible recording layer and the second thermoreversible recording layer reversibly changes in color tone depending on temperature.

<10> The image processing method according to <9>, wherein each of the first thermoreversible recording layer and the second thermoreversible recording layer contains a leuco dye and a reversible color developer.

<11> The image processing method according to <9> or <10>, wherein the light heat converting material has an absorption peak in the near-infrared region.

<12> The image processing method according to <11>, wherein the light heat converting material is a phthalocyanine compound.

<13> The image processing method according to <9> or <10>, wherein the light heat converting material is an inorganic material.

<14> An image processing apparatus including:

a laser beam emitting unit configured to emit laser beams; and a laser beam scanning unit configured to scan the laser beams on a surface of a medium where the surface is to be irradiated with the laser beams, wherein the image processing apparatus is used in the image processing method according to any one of <1> to <13>.

The image processing method and the image processing apparatus of the present invention measure the distance between the image processing apparatus and the medium where an image is to be recorded and control the irradiation energy of laser beams based on the measured distance, thereby performing high-quality image recording with less faint printing and bleeding, exhibiting improved durability to repeated printing, being low cost, and exhibiting high processing speed. Therefore, they can be widely used as, for example, an admission ticket or a sticker for a frozen food container, industrial product, every type of chemical container, or large screen and various displays for physical distribution control or manufacturing process management, and in particular are suitable for use in distribution/delivery systems, and process management systems in factories.

This application claims priority to Japanese application No. 2011-42331, filed on Feb. 28, 2011, and incorporated herein by reference.

What is claimed is:

1. An image processing method comprising:

(a) measuring a distance between a medium where an image is to be recorded and an image processing apparatus which stores a relation between irradiation energy and distance previously measured;

(b) calculating an irradiation energy from the distance measured in (a), based on the relation stored in the image processing apparatus and to obtain a line width on the medium same in width as a line width at a focal position; and (c) irradiating and heating the medium at the focal position or near the focal position with laser beams having the irradiation energy calculated in (b), to record an image in the medium, wherein a laser beam emitting unit of the image processing apparatus comprises a laser beam source and is configured to emit laser beams, and the laser beam source is a fiber coupling laser, and wherein the fiber coupling laser has a top hat-form light distribution at the focal position.

2. The image processing method according to claim 1, wherein the image processing apparatus further comprises: a laser beam scanning unit configured to scan the laser beams on a surface of the medium where the surface is to be irradiated with the laser beams; and an fθ lens, where the fθ lens corrects an irradiation distance in the surface of the medium.

3. The image processing method according to claim 1, wherein the image processing apparatus further comprises: a laser beam scanning unit configured to scan the laser beams on a surface of the medium where the surface is to be irradiated with the laser beams; and a lens system disposed between the laser beam emitting unit and the laser beam scanning unit and configured to correct a focal length, where the lens system corrects at least one of a position of the medium and an irradiation distance in the surface of the medium.

4. The image processing method according to claim 1, wherein the image processing apparatus further comprises: and a laser beam scanning unit configured to scan the laser beams on a surface of the medium where the surface is to be irradiated with the laser beams, where the image processing apparatus adjusts an irradiation energy to correct at least one of a position of the medium and an irradiation distance in the surface of the medium.

5. The image processing method according to claim 1, wherein the irradiation energy of the laser beams is adjusted by adjusting an irradiation power of the laser beams.

6. The image processing method according to claim 1, wherein the irradiation energy of the laser beams is adjusted by adjusting a scanning velocity of the laser beams.

7. The image processing method according to claim 1, wherein the laser beams with which the medium is irradiated have a wavelength of 700 nm to 1,600 nm.

8. The image processing method according to claim 1, wherein the medium is a thermoreversible recording medium comprising: a support; a first thermoreversible recording layer; a light heat converting layer containing a light heat converting material which absorbs light having a specific wavelength and converts the light to heat; and a second thermoreversible recording layer, where the first thermoreversible recording layer, the light heat converting layer, and the second thermoreversible recording layer are provided on the support in this order, and wherein each of the first thermoreversible recording layer and the second thermoreversible recording layer reversibly changes in color tone depending on temperature.

9. The image processing method according to claim 8, wherein each of the first thermoreversible recording layer and the second thermoreversible recording layer contains a leuco dye and a reversible color developer.

10. The image processing method according to claim 9, wherein the light heat converting material has an absorption peak in the near-infrared region.

11. The image processing method according to claim 8, wherein the light heat converting material has an absorption peak in the near-infrared region.

12. The image processing method according to claim 11, wherein the light heat converting material is a phthalocyanine compound.

13. The image processing method according to claim 8, wherein the light heat converting material is an inorganic material.

14. An image processing apparatus comprising:

a laser beam emitting unit configured to emit laser beams; and a laser beam scanning unit configured to scan the laser beams on a surface of a medium where the surface is to be irradiated with the laser beams, wherein the laser beam emitting unit comprises a laser beam source, and the laser beam source is a fiber coupling laser, wherein the fiber coupling laser has a top hat-form light distribution at a focal position, and wherein the image processing apparatus is used in an image processing method which comprises:

(a) measuring a distance between the medium where an image is to be recorded and the image processing apparatus which stores a relation between irradiation energy and distance previously measured, (b) calculating an irradiation energy from the distance measured in (a), based on the relation stored in the image processing apparatus and to obtain a line width on the medium same in width as a line width at the focal position; and (c) irradiating and heating the medium at the focal position or near the focal position with laser beams having the irradiation energy calculated in (b), to record an image in the medium.

* * * * *